US006929059B2

(12) United States Patent
Kim et al.

(10) Patent No.: US 6,929,059 B2
(45) Date of Patent: Aug. 16, 2005

(54) ALUMINUM RADIATOR AND METHOD OF MANUFACTURING TANK THEREOF

(75) Inventors: Yongho Kim, Daejeon-si (KR); Sungje Lee, Daejeon-si (KR); Gilwoong Jun, Daejeon-si (KR); Sangmin Lee, Daejeon-si (KR); Kihong Kim, Daejeon-si (KR); Yongjun Jee, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 0 days.

(21) Appl. No.: 10/119,487

(22) Filed: Apr. 9, 2002

(65) Prior Publication Data

US 2002/0144805 A1 Oct. 10, 2002

(30) Foreign Application Priority Data

Apr. 9, 2001 (KR) ..... 2001-18620
Sep. 6, 2001 (KR) ..... 2001-54781
Dec. 7, 2001 (KR) ..... 2001-77366

(51) Int. Cl.[7] ..... F28D 1/053; F28F 9/02
(52) U.S. Cl. ..... 165/153; 165/173; 165/175
(58) Field of Search ..... 165/153, 173, 165/175

(56) References Cited

U.S. PATENT DOCUMENTS 4,693,307 A * 9/1987 Scarselletta ..... 165/153
5,076,354 A * 12/1991 Nishishita ..... 165/153
5,195,581 A * 3/1993 Puntambekar et al. ..... 165/173
5,246,065 A * 9/1993 Huff ..... 165/173
5,251,692 A * 10/1993 Haussmann ..... 165/153
5,366,008 A * 11/1994 Kadle et al. ..... 165/173
6,035,931 A * 3/2000 Kado et al. ..... 165/153
6,167,953 B1 * 1/2001 Kobayashi et al. ..... 165/173
6,173,765 B1 1/2001 Uchikawa et al.

FOREIGN PATENT DOCUMENTS

EP 371532 A1 * 6/1990 ..... 165/173
FR 2614408 A1 * 10/1988 ..... 165/173
JP 10132490 5/1998
JP 11118386 4/1999
JP 00220988 8/2000

* cited by examiner

*Primary Examiner*—Leonard R. Leo
(74) *Attorney, Agent, or Firm*—Sheridan Ross PC

(57) ABSTRACT

An aluminum radiator includes a core including a plurality of tubes through which a heat exchange medium flows and fins arranged between the tubes; and a header tank including a pair of header spaced apart from each other and having both ends coupled to the tube, a tank coupled to the header by a brazing and having a heat exchange medium passage formed therein, and end caps coupled to both opening portions of the tank, wherein the tube satisfies an inequality 10 mm≦T≦20 mm, where T denotes an outside width of the tube, and the tank has an inside height (H) of 41 mm or less and satisfies an inequality 1.5≦H/T≦2.5.

4 Claims, 29 Drawing Sheets

ALUMINUM RADIATOR AND METHOD OF MANUFACTURING TANK THEREOF

BACKGROUND OF THE INVENTION

1. Field of the Invention

The present invention relates to an aluminum radiator and a manufacturing a tank thereof.

2. Description of Related Art

In general, in a vehicle including an internal combustion engine, a heat generated during an operation of an engine is transmitted to a cylinder head, a piston, a valve, and so on, and an excessively high heat weakens a strength of parts, shortens a life span of the engine, or causes an abnormal combustion which leads to a knocking or a pre-ignition and thus lowers an engine output.

In addition, when the engine is cooled unstably, an oil film of a cylinder inner surface is cut, and an engine oil is changed in quality. As a result, a lubricating function deteriorates, and an abnormal abrasion is caused in the cylinder. Furthermore, the piston may be glued to an inner wall of the cylinder.

For the sake of the reasons, a water-cooled cooling device is installed in a vehicle in order to cool the engine.

The water-cooled cooling device circulates a cooling water to a cylinder block and a cylinder head by a water pump to lower a temperature of an engine. Such a water-cooled cooling device includes a radiator, a cooling fan, and a water temperature controller in order to radiate heat of a cooling water. Of these, the radiator is an apparatus which radiates a heat and cools a high temperature cooling water.

FIG. 1 is a perspective view of a conventional plastic radiator. FIG. 2 is a partially cut perspective view of the conventional plastic radiator. FIG. 3 is a cross-sectional view of the conventional plastic radiator.

The conventional plastic radiator 1 includes header tanks 2 and 3, a core 4, and a support 7.

The header tanks include headers 2*a* and 3*a* and tanks 2*b* and 3*b*, respectively. The headers 2*a* and 3*a* are spaced apart from each other. The tanks 2*b* and 3*b* are coupled to the headers 2*a* and 3*a* by a brazing and have a heat exchange medium passage formed therein, respectively.

The core 4 includes a plurality of tubes 4*a* and fins 4*b* arranged between the tubes 4*a*. The tube 4*a* is coupled to a pair of the header 2*a* and 3*a* and communicates with the passage of the tanks 2*b* and 3*b*. A heat exchange medium flows through the tube 4*a*.

The support 7 is coupled to the headers 2*a* and 3*a* to support the most outer tube among the tubes 4*a*.

Meanwhile, the core 4 and the headers 2*a* and 3*a* are made of aluminum, and the tanks 2*b* and 3*a* are made of a synthetic resin such as a polyamide. Since the headers 2*a* and 3*a* and the tanks 2*b* and 3*b* differ in material, the headers 2*a* and 3*a* and the tanks 2*b* and 3*b* are coupled by a mechanical coupling method.

In other words, the headers 2*a* and 3*a* include a plurality of tap portions 2*c* formed along an edge thereof and spaced apart from each other. A plurality of the tap portions 2*c* are bent to surround the tanks 2*b* and 3*b*, so that the headers 2*a* and 3*a* and the tanks 2*b* and 3*b* are firmly coupled.

A gasket 5 is interposed between the headers 2*a* and 3*a* and the tanks 2*b* and 3*b* to prevent a cooling water from being leaked.

However, the conventional radiator has the following disadvantages.

Firstly, the conventional radiator is difficult to recycle because components are made of different materials. For example, the core is made of aluminum, the gasket is made of a rubber such as an ethylene-propylene rubber (EPDM), and the tank is made of a plastic. Even though the core and the header made of aluminum are recycled, the core and the header have to be separated from the plastic tank for a recycling. Therefore, the work process number for a recycling is increased.

Secondly, an assembly process is complicated, and thus a manufacturing cost is increased. In order to prevent the cooling water from being leaked, a calking process is required that arranges the gasket and fixes the tank using the tap portions of the header.

Thirdly, a coupling between the header and the tank is relatively weak. Even though the tap portions of the header presses the tank made of a plastic, when an inner pressure of the radiator is increased, the tap portion becomes wider, thereby forming a crevice.

Further, when an interference between an appendage (e.g., a cooling water inlet/outlet or a vehicle body mounting pin) arranged necessarily in the tank and the tap portion occurs, since a calking for the tap portion is not performed, a non-calking portion is lower in strength than the other portions.

Fourthly, the plastic tank may be broken. Even though the tank is strong in brittleness and is excellent in strength, since the tank is not transformed, the cooling water may be leaked, and a crack may occur that affects an engine cooling. Such a crack results from either a pressure of the tap portion 2*c* pressing the tank during a calking process, a vibration of a vehicle body, a material characteristic, or an injection molding condition. However, there is no method to inspect a weak portion such as a crack until the radiator is completed, and thus a product reliability is lowered.

Fifthly, the header and the tank are made by separate molds. In case that a vehicle is different in kind and the radiator has different number of tubes, the different molds are used to manufacture the header and the tank.

In order to overcome the problems, the radiator having an aluminum tank has been introduced. Using the aluminum tank, parts of the tank are easy to manufacture, and components of the radiator are assembled temporarily and then brazed to complete the radiator, whereby a calking process is not required.

In addition, the header and the tank are made of the same material and thus are easy to recycle. The header and the tank joined by a brazing are excellent in strength and durability.

However, the aluminum tank has to satisfy the following requirement.

Firstly, the aluminum tank has to be simple in shape. The tank having a complicated shape is difficult to be compatible with various kinds of vehicles, leading to a high manufacturing cost.

Secondly, since the aluminum tank is coupled to the header by the brazing, a coupling force between the aluminum tank and the header is stronger than in the plastic tank, and a crack does not occur in the tank. But, the aluminum tank has to have a strength as strong as the plastic tank without increasing a coupling force of other parts and a material thickness.

Thirdly, the upper and lower tanks have to be used commonly. Since the plastic tank is formed by an injection molding together with most appendages, the upper and lower tanks differ necessarily in shape. However, in case of the aluminum tank, since all appendages are made separately and then attached to the tank, the upper and lower tanks have to have the same shape.

Fourthly, the aluminum tank has not to be transformed. The aluminum tank is not broken but can be transformed permanently due to an inner pressure. Such a transformation can be prevented by increasing a material thickness of the tank and varying a size of the tank. However, when a thickness of the tank is increased, a manufacturing cost is increased, and a size of the tank becomes small. As a result, a performance of the radiator can be lowered. Therefore, the aluminum tank has not to be transformed without increasing a thickness thereof.

Japanese Patent Publication Nos. 11-118386 and 2000-220988 disclose an aluminum radiator having an aluminum tank. However, the aluminum radiator does not consider fundamental shortcomings such as a transformation volume of the radiator according to a pressure drop, and a size of the radiator determining its performance at all.

Therefore, there is a need for an aluminum radiator that can minimize a transformation volume of the radiator and have an optimum size of maximizing its performance.

FIG. 4 is a perspective view of a conventional aluminum radiator. FIG. 5 is a cross-sectional view of the conventional aluminum radiator.

The aluminum radiator 10 includes a header tank 20 and 30, a core 40 and a support 50.

The header tank 20 includes a pair of header 21 spaced apart from each other, a tank 22 coupled to a pair of the header 21 by a brazing and having a heat exchange medium passage formed therein, and end caps 23 coupled to both opening portions of the header 21 and the tank 22. The header tank 30 has the same configuration as the header tank 20, and thus its description is omitted to avoid a redundancy.

The core 40 includes a plurality of tubes 41 and fins 42 arranged between the tubes 41. The tube 41 is coupled to a pair of the header 21 and communicates with the passage of the tanks 22. A heat exchange medium flows through the tube 41.

The support 50 is coupled to the headers 21 to support the most outer tube among the tubes 41.

The header 21 includes a flat portion 21*a* having a predetermined length and a tank coupling portion 21*b* bent from both ends of the flat portion 21*a*. The tank 22 includes a ceiling portion 22*a* having a predetermined length and a header coupling portion 22*b* bent from the ceiling portion 22*a*. The header coupling portion 22*b* of the tank 22 is coupled to the tank coupling 21*a* of the header 21.

Meanwhile, in the state that the header 21, the tank 22 and the core 40 are temporarily assembled, the aluminum radiator 10 is laid on a conveyer C of a high-temperature brazing furnace and is conveyed, and the aluminum radiator 10 is brazed while conveyed.

However, as shown in FIG. 5, the aluminum radiator 10 gets to have a step difference $H_1$ between the conveyer C and the header coupling portion 22*b* when laid on the conveyer C. A covering between the tank coupling portion 21*b* and the header coupling portion 22*b* is melted due to a high-temperature brazing furnace while conveyed, and thus the tank 22 becomes sagged due to its weight as described by a dotted line. Consequently, a contact portion between the tank coupling portion 21*b* and the header coupling portion 22*b* is not perfectly brazed.

A phenomenon that the header coupling portion 22*b* is sagged from the tank coupling portion 21*b* is slightly suppressed due to the end caps 23 coupled to both opening portions of the header tank 20. However, since a supporting force of the end caps 23 is much weaker than a sagging force of the tank 22, the completed radiator 10 has defects.

In order to prevent the tank 22 from sagging, a jig is interposed between the header coupling portion 22*b* and the conveyer C to settle the step difference $H_1$. However, it is difficult to arrange the jig at an accurate location, and it is also inconvenient, thereby lowering a productivity.

SUMMARY OF THE INVENTION

To overcome the problems described above, it is an object of the present invention to provide an aluminum radiator that can minimize a transformation volume thereof and has an optimum size of maximizing its performance, thereby improving a cooling efficiency.

It is another object of the present invention to provide an aluminum radiator which can prevent a tank from sagging, thereby improving a productivity.

It is a still object of the present invention to provide an aluminum radiator having a low production cost.

In order to achieve the above object, the preferred embodiments of the present invention provide an aluminum radiator, comprising: a core including a plurality of tubes through which a heat exchange medium flows and fins arranged between the tubes; and a header tank including a pair of header spaced apart from each other and having both ends coupled to the tube, a tank coupled to the header by a brazing and having a heat exchange medium passage formed therein, and end caps coupled to both opening portions of the tank, wherein the tube satisfies an inequality $10\ mm \leqq T \leqq 20\ mm$, where T denotes an outside width of the tube, and the tank has an inside height (H) of 41 mm or less and satisfies an inequality $1.5 \leqq H/T \leqq 2.5$.

The present invention further provides a method of manufacturing an aluminum radiator, comprising: passing an aluminum plate having a predetermined length and width through a plurality of first forming rolls engaged with one another to form bent portions on both ends of the aluminum plate; passing the aluminum plate having the bent portions through a plurality of second forming rolls to form curling portions folded outwardly; and passing the aluminum plate having the curling portions through a plurality of third forming rolls to define a ceiling portion and a header coupling portion.

BRIEF DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

DETAILED DESCRIPTION OF PREFFERED EMBODIMENTS

Figure 1:
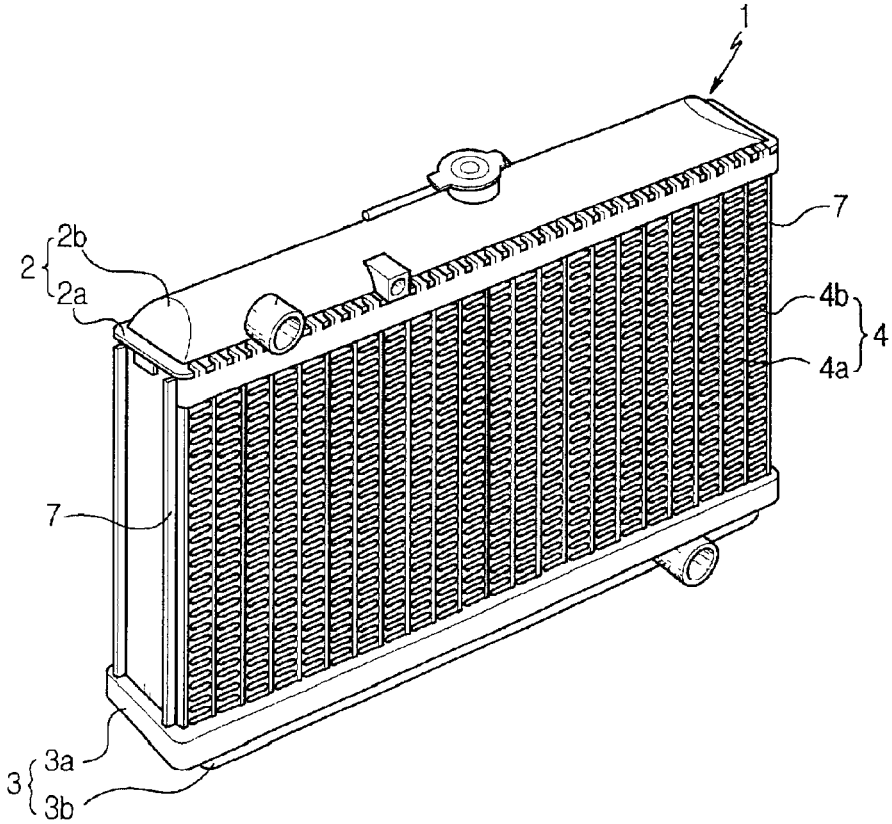
FIG. 1 Prior Art
FIG. 1 is a perspective view of a conventional plastic radiator.
Figure 2:
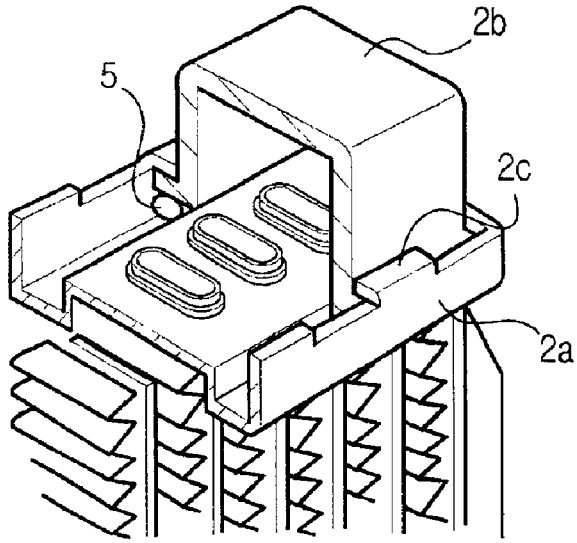
FIG. 2 Prior Art
FIG. 2 is a partially cut perspective view of the conventional plastic radiator of FIG. 1.
Figure 3:
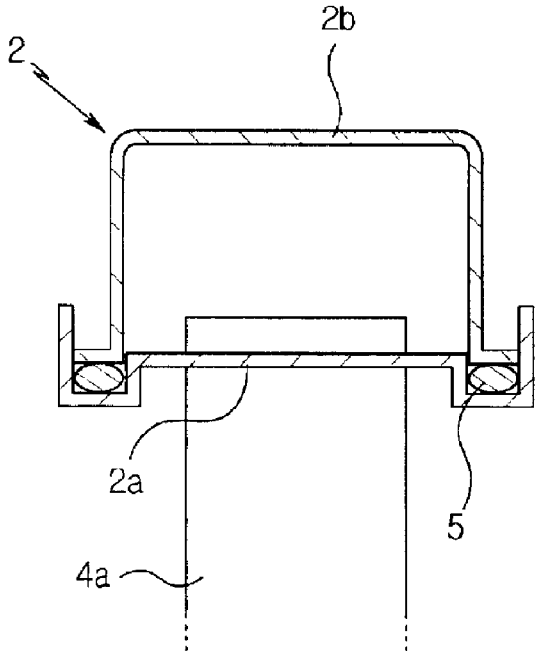
FIG. 3 Prior Art
FIG. 3 is a cross-sectional view of the conventional plastic radiator of FIG. 1.
Figure 4:
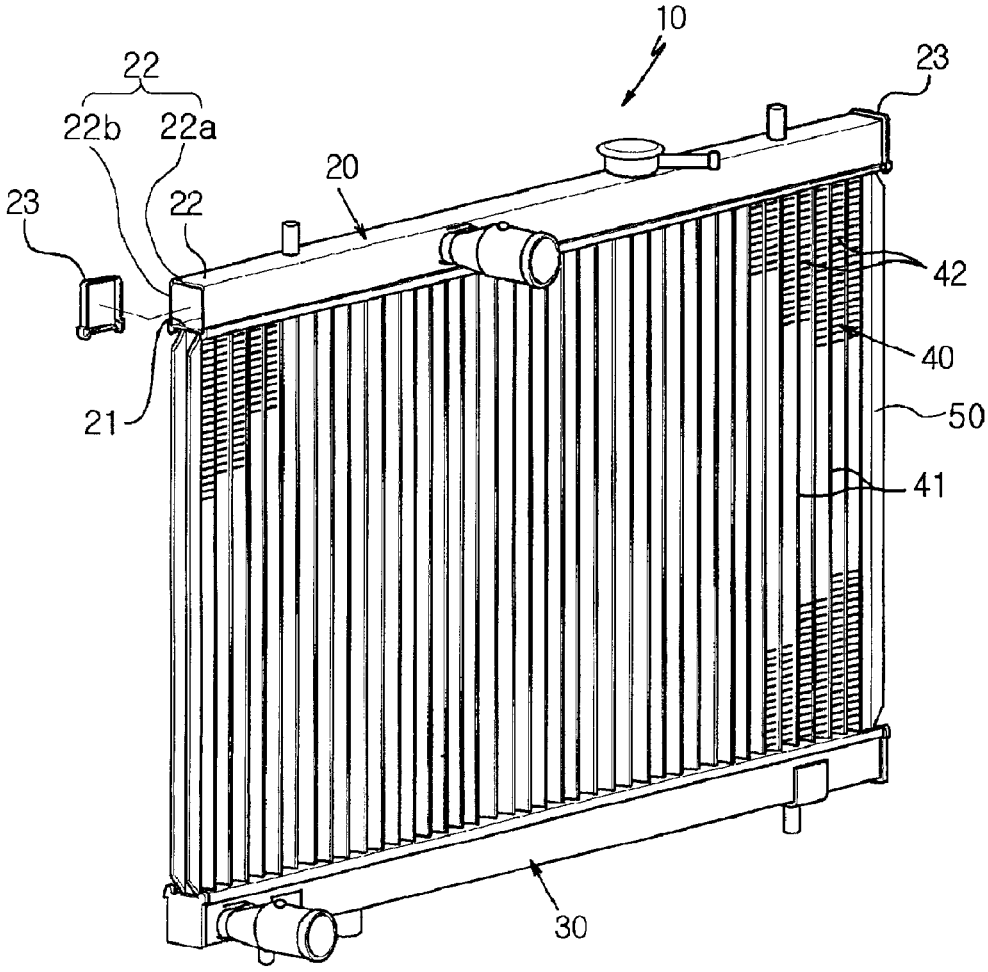
FIG. 4 Prior Art
FIG. 4 is a perspective view of another conventional aluminum radiator.
Figure 5:
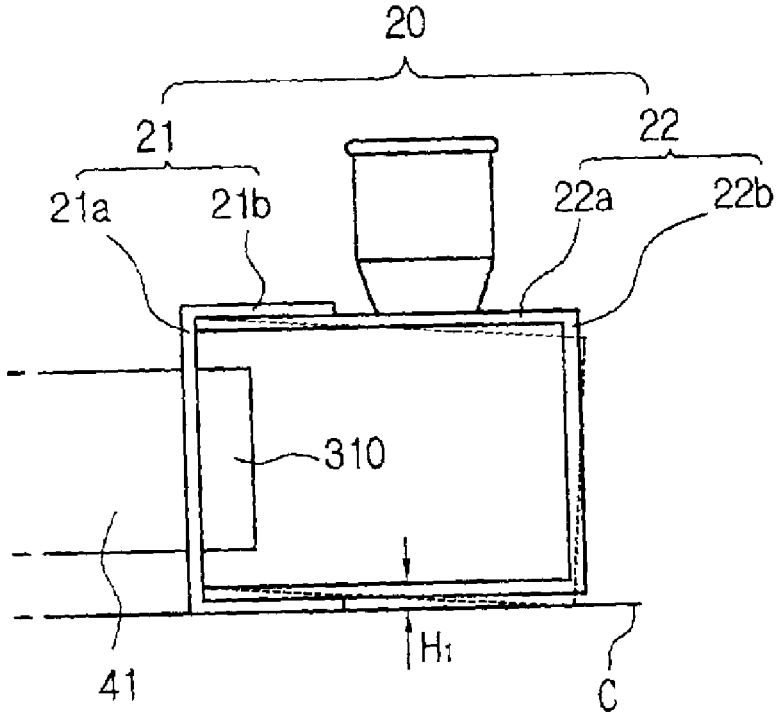
FIG. 5 Prior Art
FIG. 5 is a cross-sectional view of the conventional aluminum radiator of FIG. 4.

Reference will now be made in detail to preferred embodiments of the present invention, example of which is illustrated in the accompanying drawings. Like reference numerals denote like parts.

Figure 6:
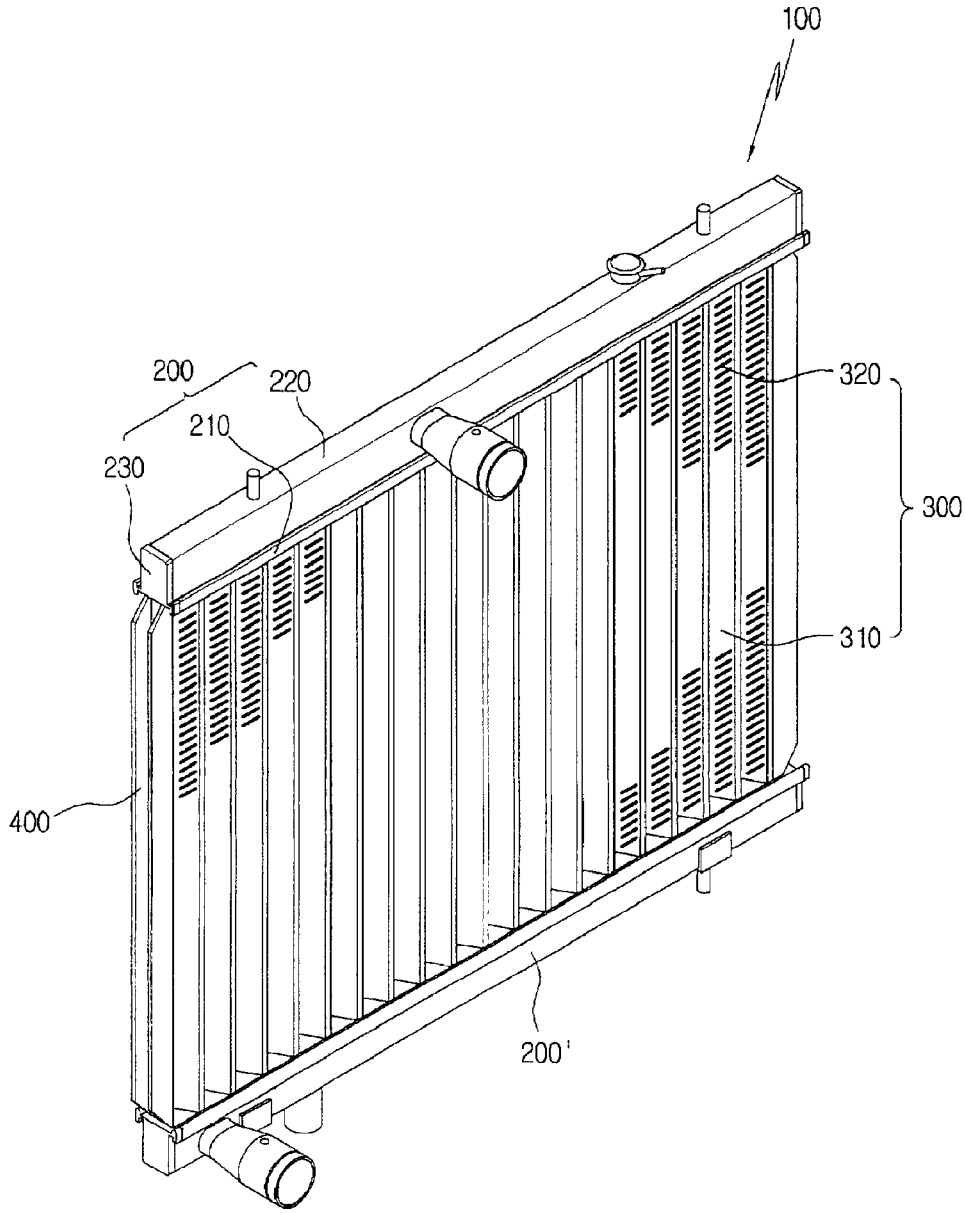
FIG. 6 is a perspective view of an aluminum radiator according to the present invention.
Figure 7:
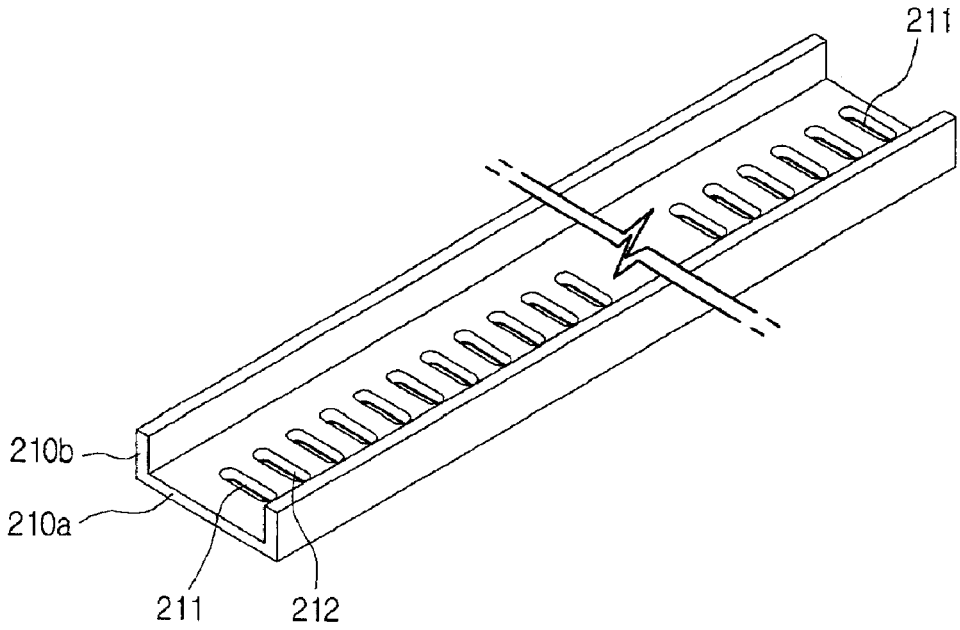
FIG. 7 is a perspective view of a header of the aluminum radiator of FIG. 6.

FIG. 6 is a perspective view of an aluminum radiator according to the present invention. FIG. 7 is a perspective view of a header of the aluminum radiator of FIG. 6.

The aluminum radiator 100 includes a header tank 200, a core 300 and a support 400.

The header tank 200 includes a pair of header 210 spaced apart from each other, a tank 220 coupled to a pair of the header 210 by a brazing and having a heat exchange medium passage formed therein, and end caps 23 coupled to both opening portions of the header 210 and the tank 220. The header tank 200' has the same configuration as the header tank 200, and thus its description is omitted to avoid a redundancy.

The core 300 includes a plurality of tubes 310 and fins 320 arranged between the tubes 310. The tube 310 is coupled to a pair of the header 210 and communicates with the passage of the tanks 22. A heat exchange medium flows through the tube 310.

The support 400 is coupled to the headers 210 to support the most outer tube among the tubes 310.

The header 210 includes a flat portion 210*a* having a predetermined length and a tank coupling portion 210*b* bent from both ends of the flat portion 210*a*. The flat portion 210*a* includes a plurality of support inserting holes 211 into which the supports 400 are inserted, and a plurality of tube inserting holes 212 into which the tubes 310 are inserted. Preferably, the support inserting hole 211 and the tube inserting holes 212 have the same shape and the same cross-sectional area. This is because it is preferred that the support inserting hole 211 and the tube inserting holes 212 are simultaneously formed by a single process.

The tank 220 includes a ceiling portion 220*a* having a predetermined length and a header coupling portion 220*b* bent from the ceiling portion 220*a*. The header coupling portion 220*b* is coupled to the tank coupling 210*a* of the header 210.

A desirable dimension of the header tank 200 of the aluminum radiator 100 is as follows: when an outside width T of the tube 310 is in a range between 10 mm and 20 mm, a ratio of an inside height H of the tank 200 to the outside width T of the tube 310 is in a range between 1.5 and 2.5: $1.5 \leqq H/T \leqq 2.5$, wherein the inside height H of the tank 200 is 41 mm or less: $H \leqq 41$ mm.

Figure 8:
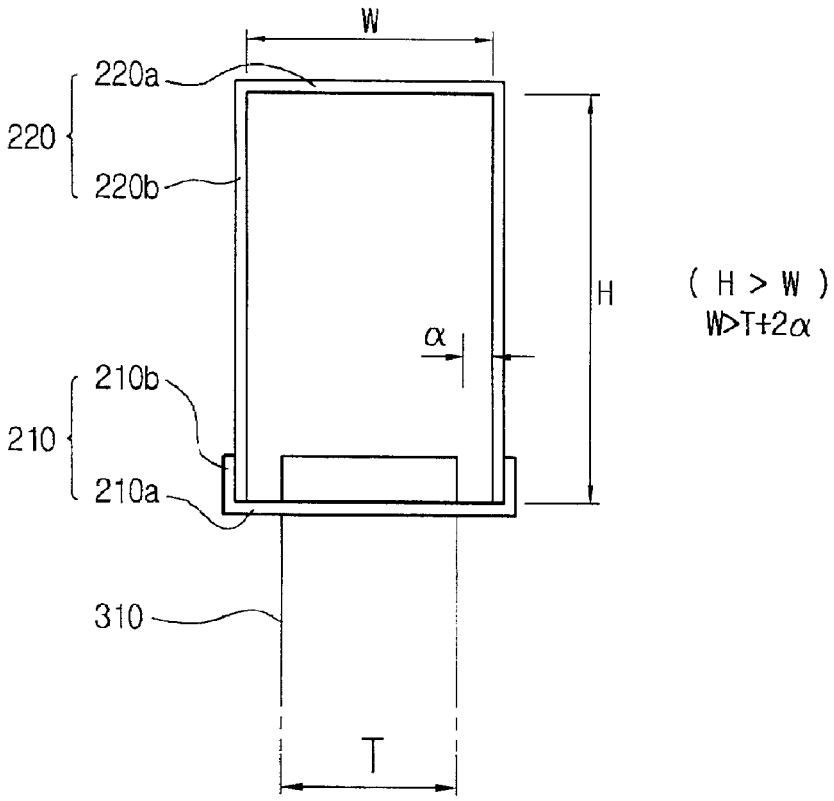
FIGS. 8 and 9 show various shapes of the header tank of the aluminum radiator according to the present invention.
Figure 9:
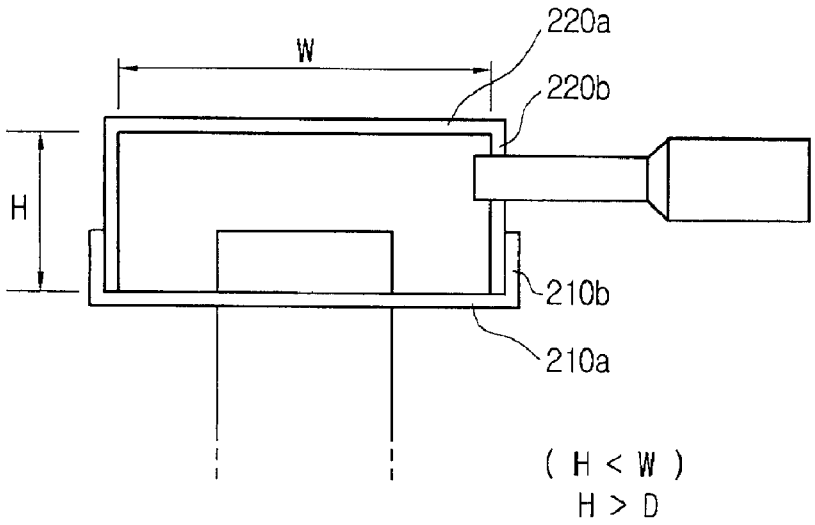

FIGS. 8 and 9 show various shapes of the header tank of the aluminum radiator according to the present invention.

The header tank 200 can have various shapes and sizes. For example, the header tank 200 is designed such that the inside height H is larger than an inside width W as shown in FIG. 8, or such that the inside height H is smaller than the inside width W as shown in FIG. 9.

The header tank of FIG. 8 has an advantage in that a longitudinal space of a vehicle is saved much, and a mounting space of a cooling water inlet/outlet pipe is easily secured. The header tank of FIG. 9 has an advantage in that a radiation area is increased, and a mounting space of a mounting pin and a cooling water injecting neck is easily secured.

A condition to obtain an optimum size of the header tank of the radiator which can minimize an amount of a used material to thereby reduce a production cost is as follows:

$W>T+2\alpha$, and $H>D$, where W denotes an inside width of the tank, H denotes an inside height of the tank, T denotes an outside width of the tube, D denotes a diameter of a cooling water inlet/outlet pipe, and $2\alpha$ denotes a minimum space required in production process.

Under such a condition, first a header width is determined, and then a tank height suitable for the header width is determined, so that a size of a tank assembly can be determined. The most important parameters which affect a dimension of the header and the tank include a pressure drop of a water in the tank and a transformation volume of the header tank.

Figure 10:
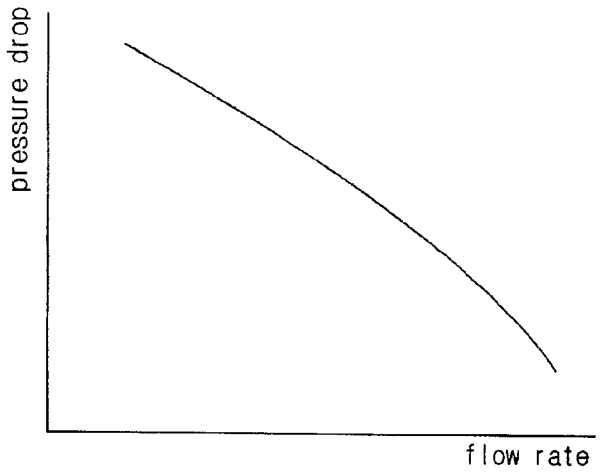
FIG. 10 is a graph illustrating a relationship between a pressure drop of a water and a flow rate of a cooling water.

FIG. 10 is a graph illustrating a performance curve of a water pump showing a relationship between a pressure drop of a cooling water and a flow rate of a cooling water. As a pressure drop of a cooling water becomes larger, a flow rate of an inflowed cooling water is reduced. As a pressure drop of a cooling water becomes smaller, a flow rate of an inflowed cooling water is increased. Therefore, a pressure drop of a cooling water has to be minimized in order to obtain an excellent performance of the aluminum radiator.

The header tank 200 can be transformed even by a very low inner pressure according to its shape. Such a transformation may cause a position of parts to be changed, and thus the header tank 200 has to have an enough strength not to be transformed when assembled.

Figure 11:
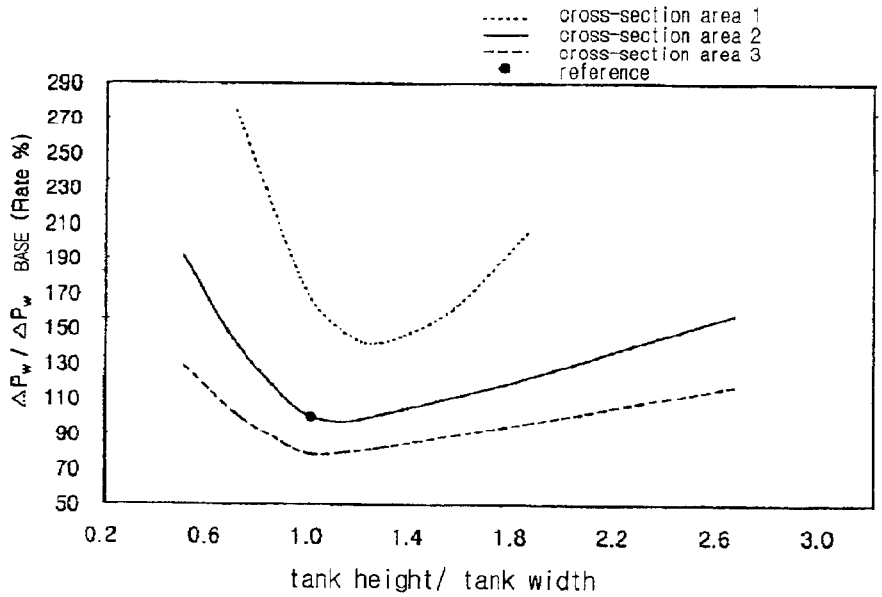
FIG. 11 is a graph illustrating a relationship between a pressure drop ratio and a height/width ratio of the tank.
Figure 12:
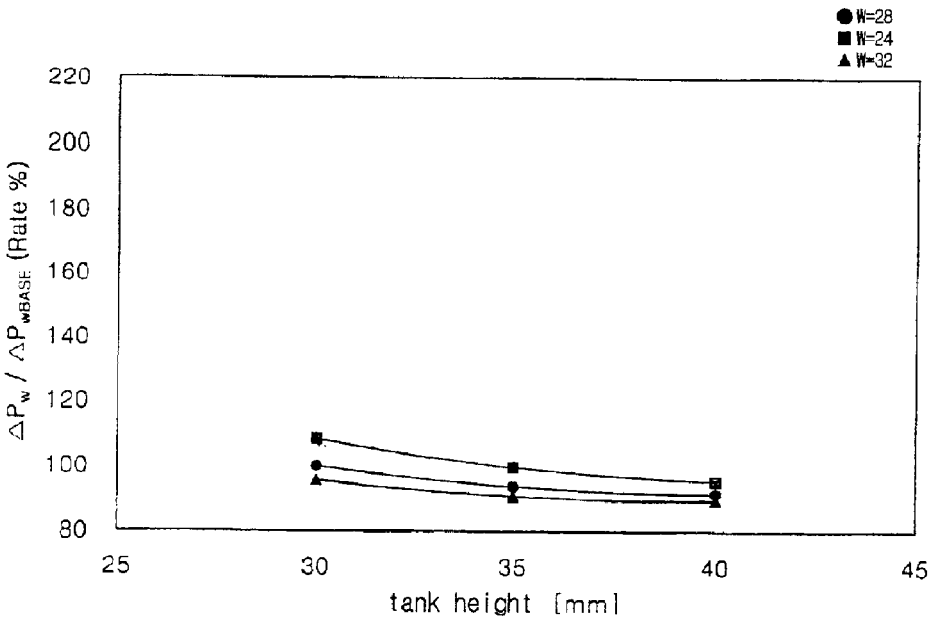
FIG. 12 is a graph illustrating a relationship between a pressure drop ratio and a height of the tank

FIG. 11 is a graph illustrating a relationship between a pressure drop ratio and a height/width (H/W) ratio of the tank. FIG. 12 is a graph illustrating a relationship between a pressure drop ratio and a height of the tank. As can bee seen in FIGS. 11 and 12, a pressure drop ratio of a cooling water depends on a height of the tank stronger than a width of the tank in a single area of a tank.

Figure 13A:
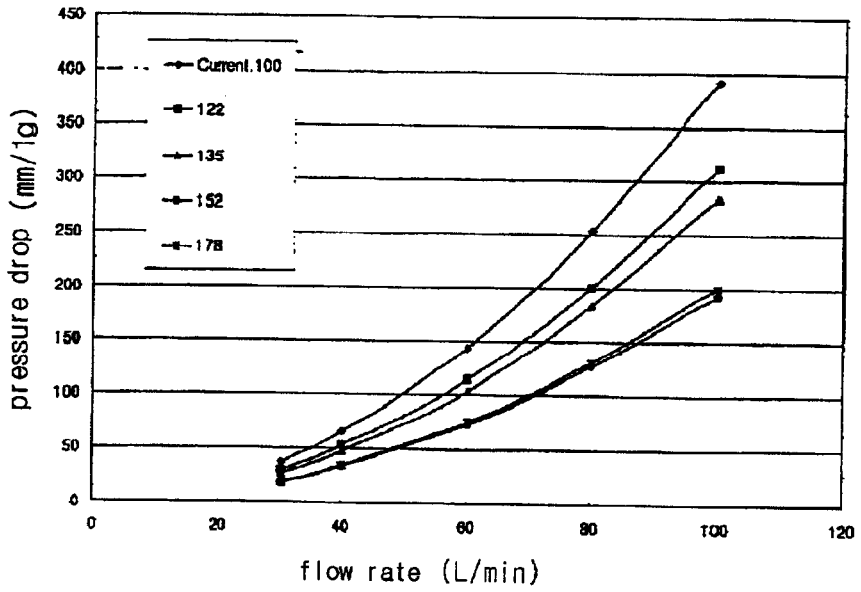
FIG. 13A is a graph illustrating a pressure drop of a water with respect to a volume of the tank.

FIG. 13A is a graph illustrating a pressure drop of a cooling water with respect to a volume of the tank. In particular, the graph of FIG. 13A is obtained such that a tank assembly is constructed by assembly different sizes of tanks with the header having a width of 24 mm, and a differential pressure of a water of the radiator with respect to a flow rate of a cooling water is measured. As can be seen in FIG. 13A, in case of the tanks having 152%- or 178%-increased volume, even though a volume of the tank is increased, a differential pressure is reduced just a little. That is, when a volume of the tank is more than a predetermined level, an amount of a material used to reduce the differential pressure is greatly increased, thereby increasing a manufacturing cost.

Figure 13B:
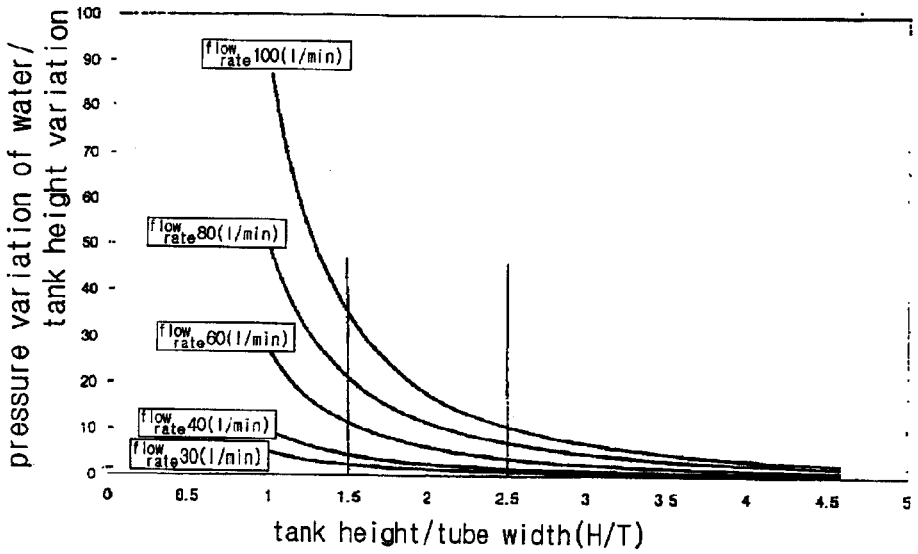
FIG. 13B is a graph illustrating a pressure drop ratio with respect to a tank height.

FIG. 13B is a graph illustrating a pressure drop ratio with respect to a tank height. In particular, FIG. 13B shows that there are points that a pressure drop ratio of a water is suddenly reduced while a tank height is increased. It is understood that when a volume of the header tank is maintained to more than a predetermined level, a pressure drop of a water in the header tank is minimized. In other words, in the header tank having the same cross section area in a longitudinal direction, a dimension of the header and the tank which can minimize a pressure loss of a water due to the tank is as follows:

$1.5 \leqq H/T \leqq 2.5$, where T denotes an inside width of the tube and is in a range between 10 mm and 20 mm, and H denotes an inside height of the tank.

A dimension of the header and the tank which can satisfy a pressure drop condition of a cooling water is determined above. Now, a dimension of the header and the tank which can minimize a transformation volume of the tank assembly will be determined below.

Figure 14:
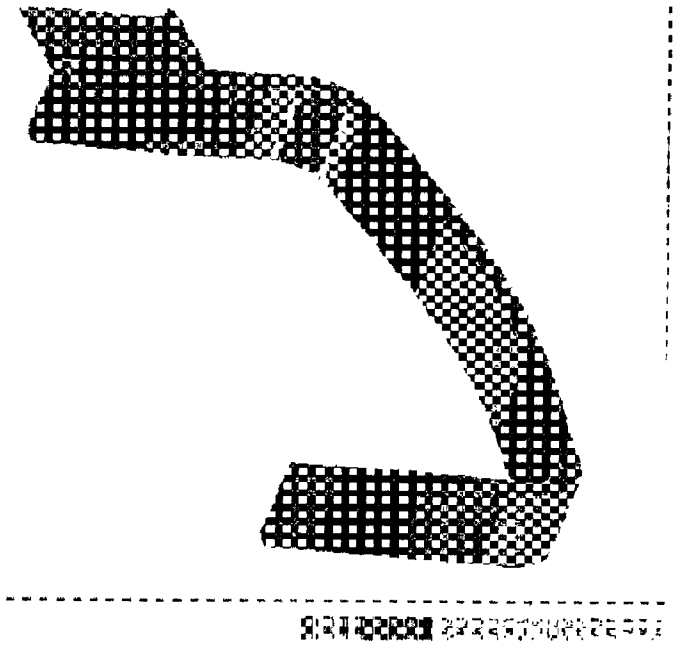
FIG. 14 shows a transformation of the aluminum radiator.
Figure 15A:
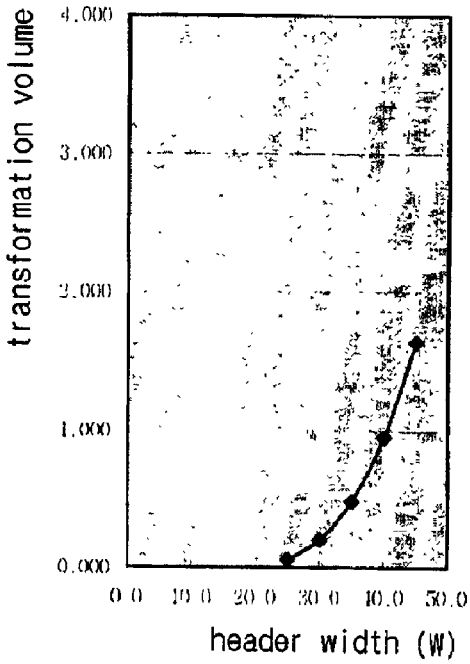
FIGS. 15A to 15D are a graph illustrating a transformation volume of the aluminum radiator with respect to parameters such as a header width, a tank height, an inside radius, and a material thickness.
Figure 15B:
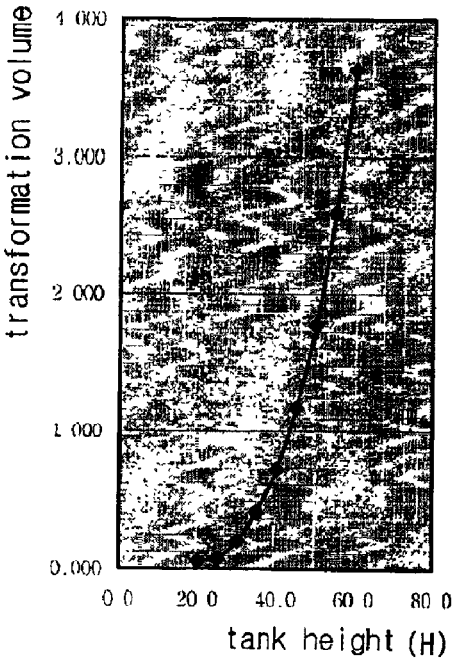
Figure 15C:
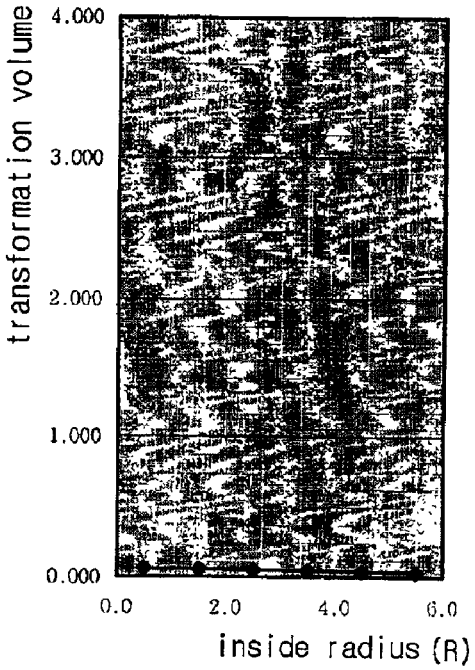
Figure 15D:
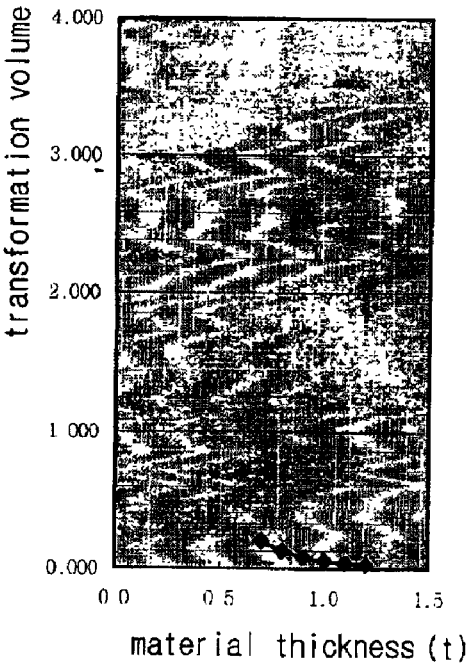

FIG. 14 shows a transformation of the aluminum radiator. It is founded by a pressure drop test of a water with respect to a volume of the header tank that the tank is concavely transformed by a very low pressure according to a shape of the header tank. The transformation occurs in all parts of the aluminum radiator regardless of certain parts such as a fin or a tube. Since an inner volume and a shape of the tank to minimize a pressure drop of a water have to be designed within a range that can solve a transformation of the tank, a structure analysis and a experiment for a transformation of the tank are performed.

Figure 16:
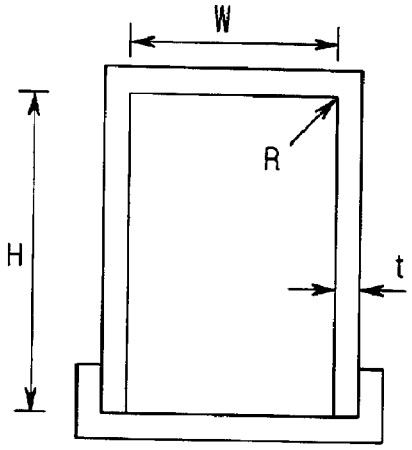
FIG. 16 is a view to define the parameters of FIG. 15.

FIGS. 15A to 15D are a graph illustrating a transformation volume of the aluminum radiator with respect to parameters such as a header width, a tank height, an inside radius, and a material thickness. The parameters are defined in FIG. 16. That is, H denotes a tank inside height, W denotes a tank inside width, R denotes an inside radius of the tank, and "t" denotes a material thickness.

Figure 17:
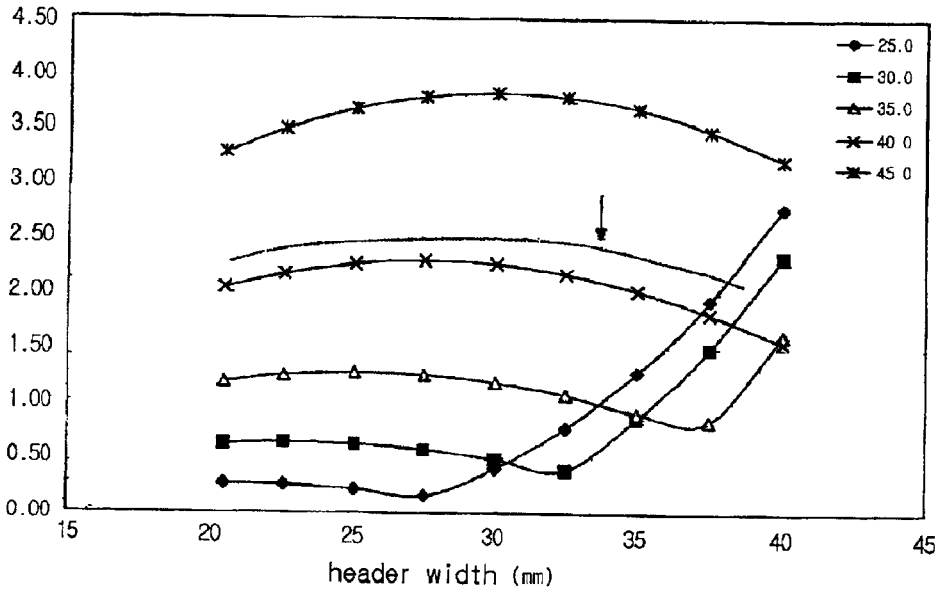
FIG. 17 is a graph illustrating a maximum transformation volume obtained when a predetermined pressure is applied to an inside of the tank assembly

FIG. 17 is a graph illustrating a maximum transformation volume obtained when a predetermined pressure is applied to an inside of the tank assembly wherein the tank assembly has a rectangular cross-section and has a material thickness t.

As can be seen in FIG. 17, when the inside height H of the tank H is less than 41 mm, a section that does not exceed a limit transformation volume according to a header width exists. The limit transformation volume according to the present invention is set to 2.5. The limit transformation volume is a value that the radiator can operates normally even at a pressure twice as high as a maximum operating pressure without a variation of a size or a location of parts attached to the header tank.

In other words, when a height H of the tank is 41 mm or less, a transformation volume of the tank satisfies a required level.

As described herein before, a dimension of the header and the tank which can minimize a pressure drop of a water in the tank and a transformation volume of the tank is determined. That is, when a tube width is in a range between 12 mm and 20 mm, a condition to minimize a pressure drop of a water is $1.5 \leqq H/T \leqq 2.5$, and a condition to minimize a transformation volume of the tank is $H \leqq 41$ mm.

The aluminum radiator according to the present invention has the following advantages.

Firstly, since the tank and the tank are simple in shape, the aluminum radiator is easy to be compatible with various kinds of vehicles.

Secondly, since the aluminum tank is coupled to the header by the brazing, a coupling force between the aluminum tank and the header is stronger than in the plastic tank, and a crack does not occur in the tank. In addition, the aluminum tank has a strength as strong as the plastic tank without increasing a coupling force of other parts and a material thickness.

Thirdly, since all appendages are made separately and then attached to the tank, one tank can be commonly used as the upper and lower tanks.

Fourthly, an occurrence of a transformation of the tank is minimized without increasing a material thickness of the tank.

An aluminum radiator having a structure which can prevent the tank from sagging will be described below.

The aluminum radiator having a structure which can prevent the tank from sagging is preferably based on a structure of the aluminum radiator which can minimize a pressure drop of a water in the tank and a transformation volume of the tank. That is, in the aluminum radiator having a structure which can prevent the tank from sagging, the tube satisfies an inequality 10 mm≦T≦20 mm, and the tank satisfies an inequality 1.5≦H/T≦2.5, H≦41 mm.

Figure 18:
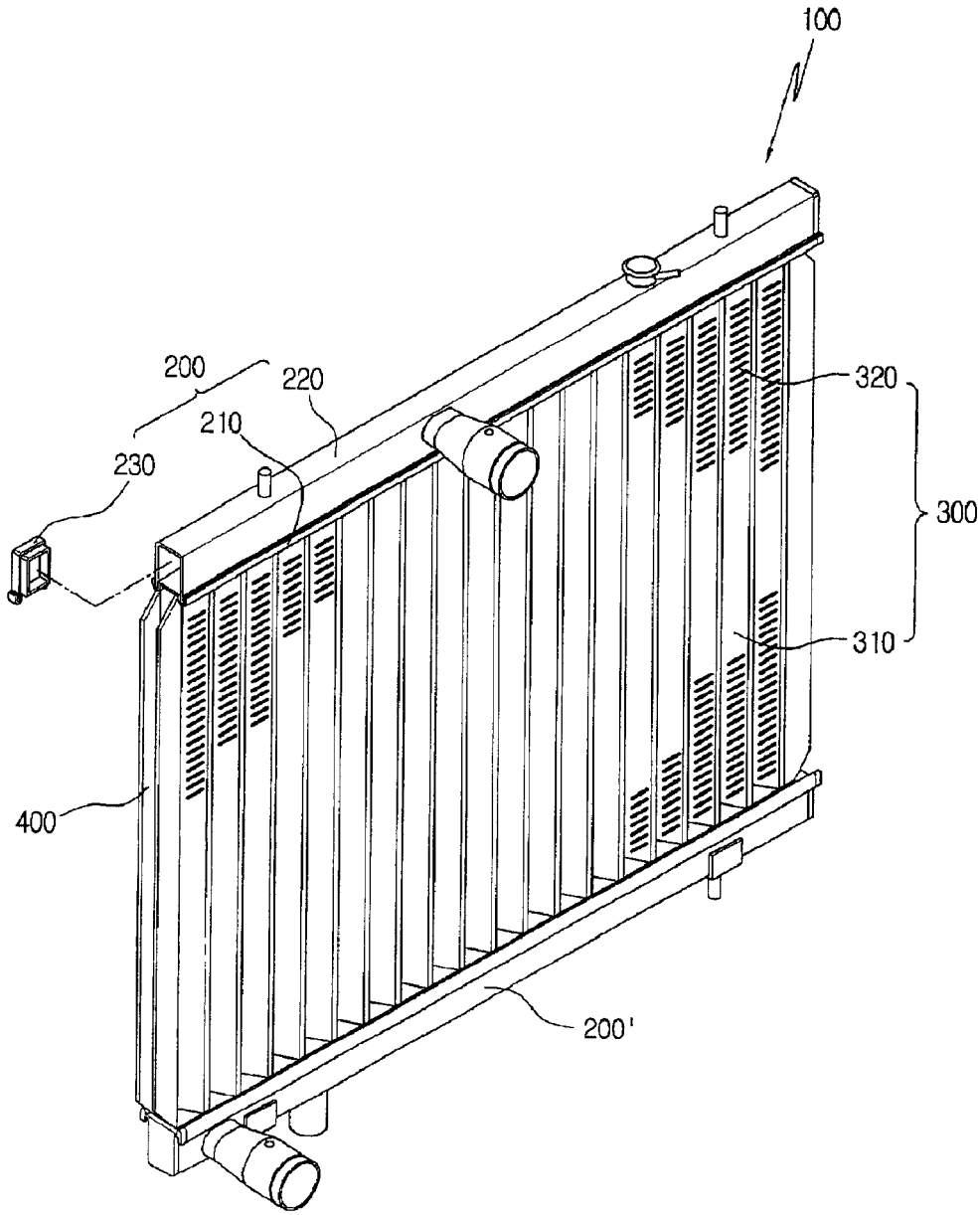
FIG. 18 is a perspective view of an aluminum radiator according to a first embodiment of the present invention.
Figure 19:
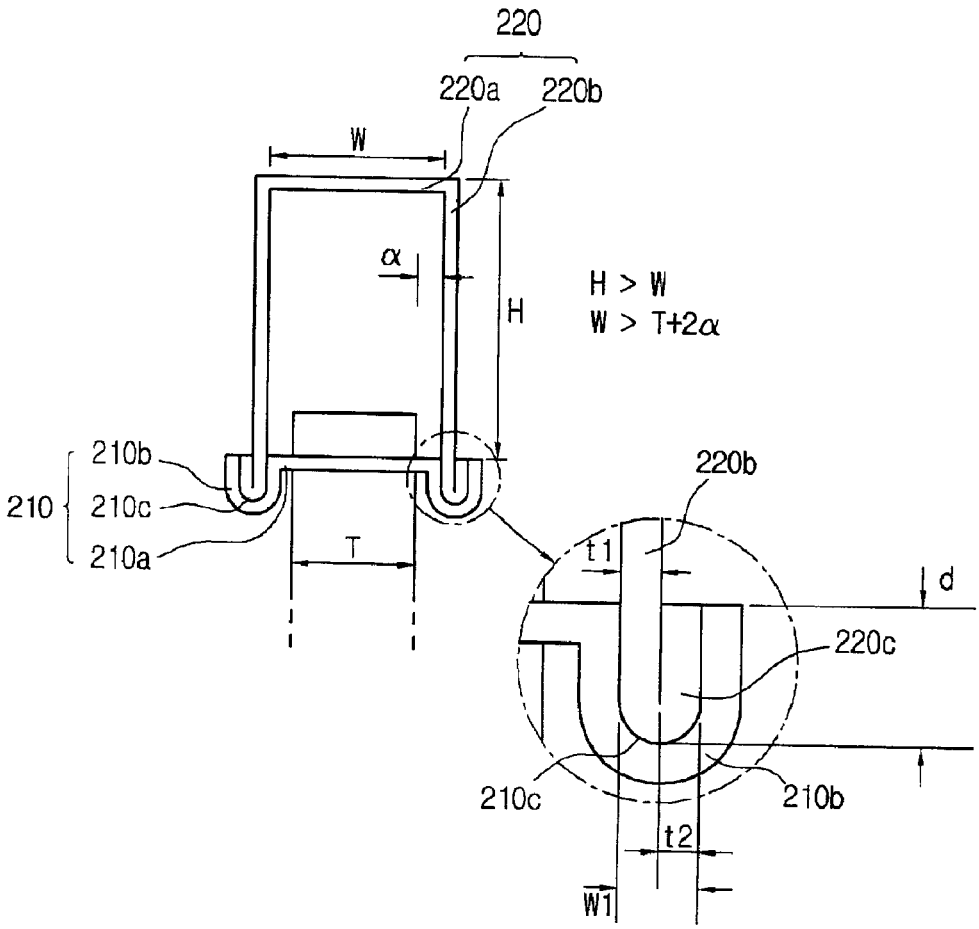
FIG. 19 is a cross-sectional view of the aluminum radiator of FIG. 18.

FIG. 18 is a perspective view of an aluminum radiator according to a first embodiment of the present invention. FIG. 19 is a cross-sectional view of the aluminum radiator of FIG. 18.

The header 210 includes a flat portion 210*a* having a predetermined length, and a tank coupling portion 210*b* bent from the flat portion 210*a* and having a reception groove 210*c*. The tank 220 includes a ceiling portion 220*a* having a predetermined length, a header coupling portion 220*b* bent from the ceiling portion 220*a*, and a curling portion 220*c* folded outwardly at an end portion of the header coupling portion 220*b*. The curling portion 220*c* of the tank 220 is received by the reception groove 210*c* when the tank 220 is coupled to the header 210.

A width W1 of the reception groove 210*c* of the header 210 is identical to a sum of a thickness $t_1$ of the header coupling portion 220*b* and a thickness $t_2$ of the curling portion 220*c*. An inner surface of the reception groove 210*c* and an outer surface of the curling portion 220*c* have the same curvature, so that a crevice does not exist between the reception groove 210*c* and the curling portion 220*c* when the header 210 is coupled to the tank 220. Such a coupling structure of the header tank 200 prevents the tank 220 from sagging when the aluminum radiator is laid and conveyed on the conveyer C of a brazing furnace.

The reception groove 210*c* has a depth d enough to prevent the tank 220 from sagging. Preferably, the depth d of the reception 210*c* is in a range between 3 mm and 5 mm.

Figure 20:
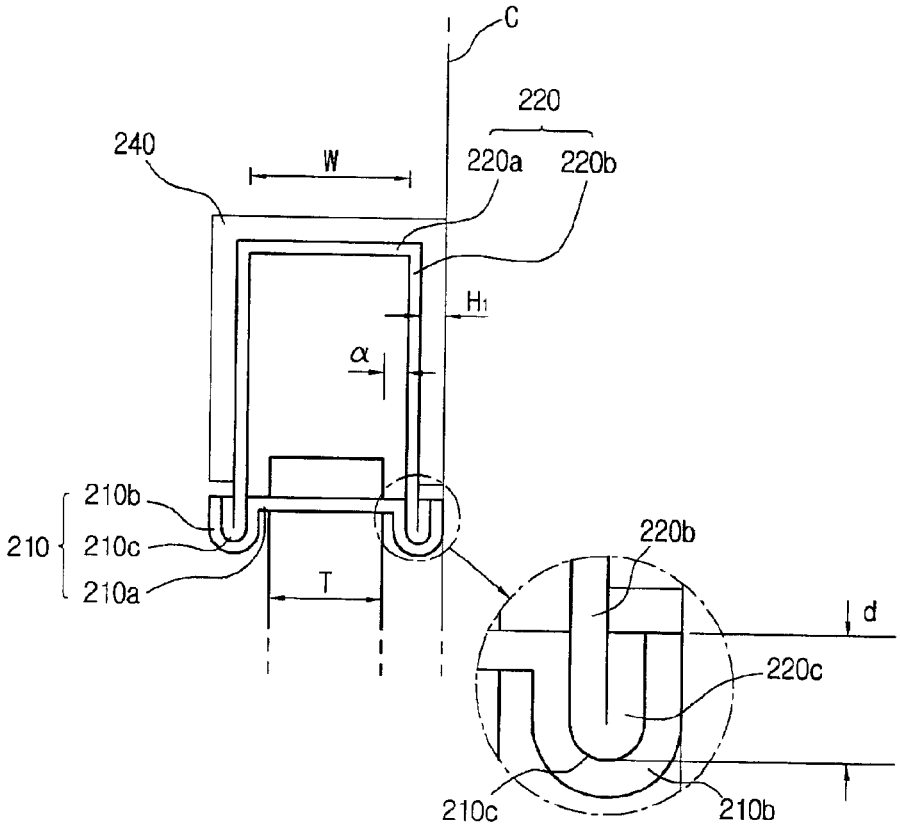
FIGS. 20 and 21 are cross-sectional views illustrating an aluminum radiator including a sag-preventing auxiliary mean according to the first embodiment of the present invention
Figure 21:
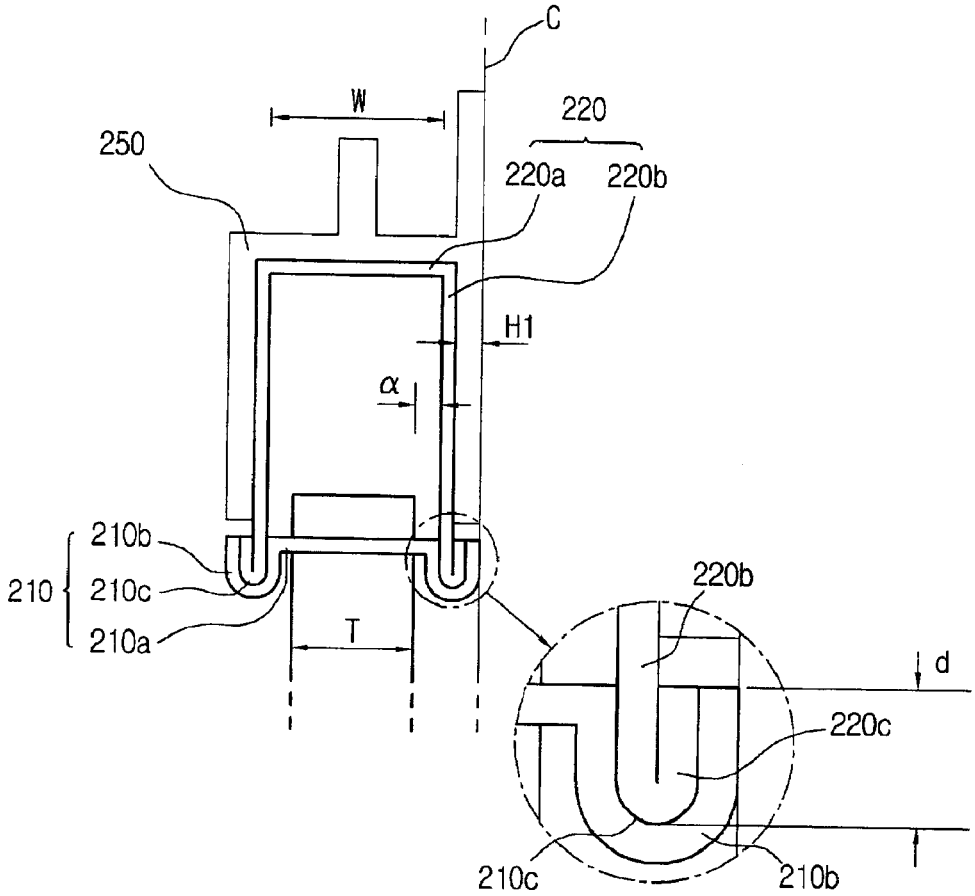

The aluminum radiator 100 according to the first present invention can further include a sag-preventing auxiliary means to prevent the tank 220 from sagging as shown in FIGS. 20 and 21.

Referring to FIG. 20, a plurality of sag-preventing auxiliary means 240 having the same thickness as a step difference $H_1$ between the tank 20 and the conveyer C are arranged on an outer surface of the tank 220 at a regular interval. The protrusion height of the end cap 230 preferably is identical to the thickness $H_1$ of the sag-preventing auxiliary means 240. Therefore, when the aluminum radiator 100 is laid on the conveyer C, the sag-preventing means 240 and the end cap 230 form a flat surface.

Referring to FIG. 21, a plurality of mounting bracket 250 having the same thickness as a step difference $H_1$ between the tank 20 and the conveyer C are arranged on an outer surface of the tank 220. One portion of the mounting bracket 250 serves to prevent the tank 220 from sagging, and the other portion of the mounting bracket 250 is coupled to a vehicle body. The protrusion height of the end cap 230 preferably is identical to the thickness $H_1$ of the mounting bracket 250.

Figure 22:
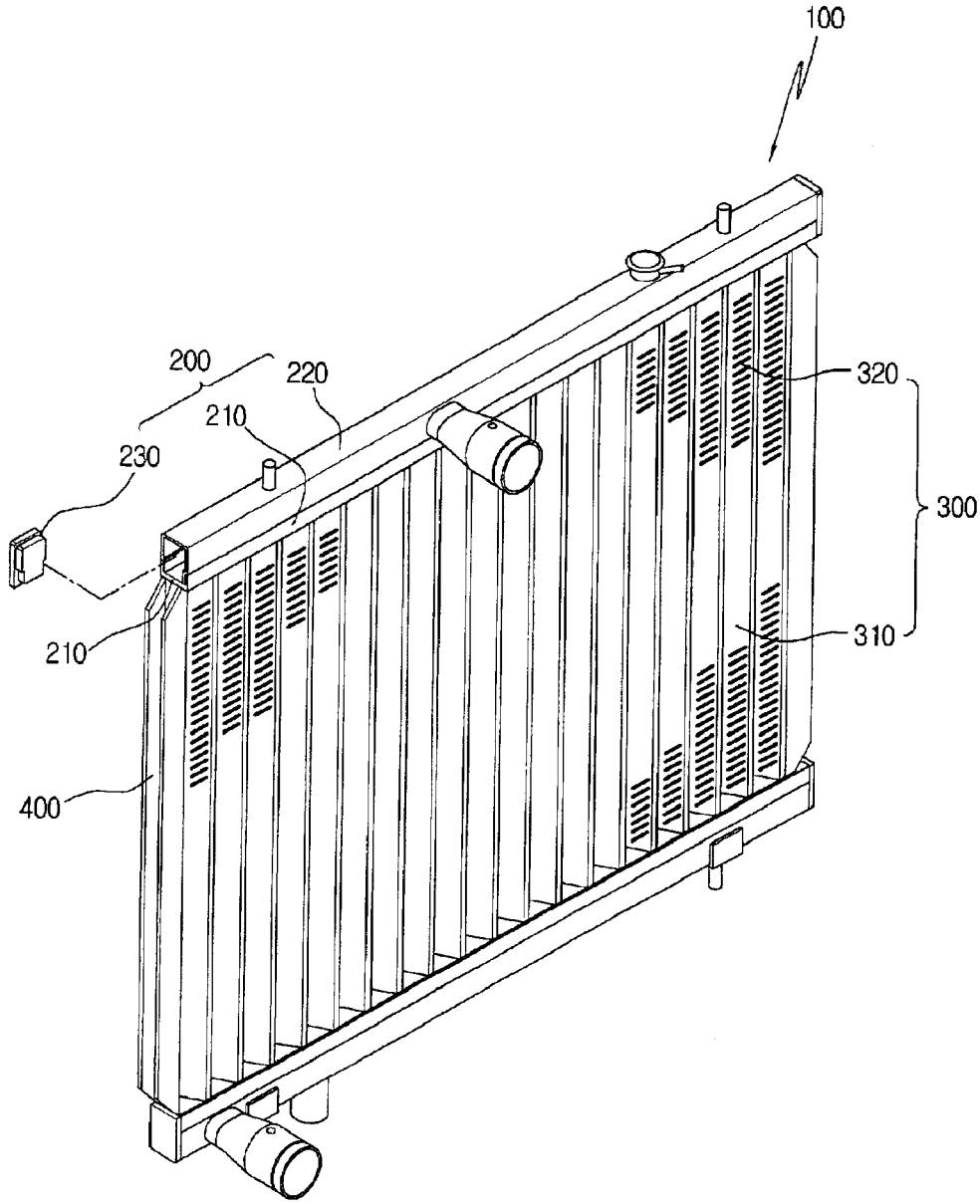
FIG. 22 is a perspective view of an aluminum radiator according to a second embodiment of the present invention.
Figure 23:
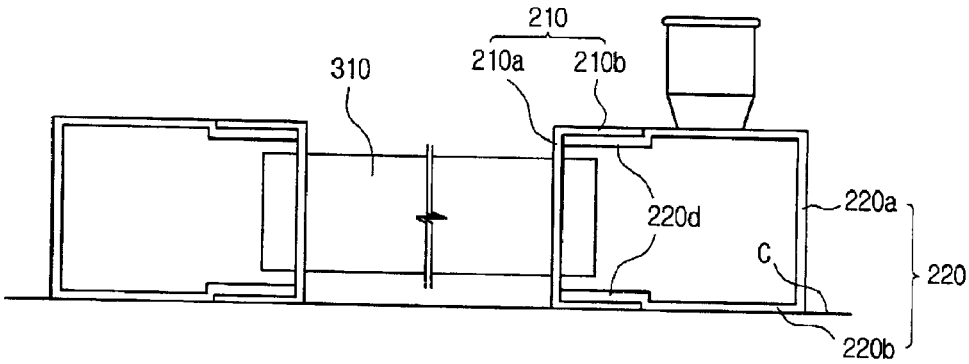
FIG. 23 is a cross-sectional view of the aluminum radiator of FIG. 22.

FIG. 22 is a perspective view of an aluminum radiator according to a second embodiment of the present invention. FIG. 23 is a cross-sectional view of the aluminum radiator of FIG. 22.

Referring to FIG. 23, the header 210 includes a flat portion 210*a* having a predetermined length, and a tank coupling portion 210*b* vertically bent from the flat portion 210*a*. The tank 220 includes a ceiling portion 220*a* having a predetermined length, and a header coupling portion 220*b* vertically bent from the ceiling portion 220*a* and having a bent portion 220*d*.

A step difference of the bent portion 220*d* is identical to a thickness of the tank coupling portion 210*b*. Therefore, when the bent portion 220*d* of the header coupling portion 220*b* is coupled to the tank coupling portion 210*b* of the header 210, a step difference between the header coupling portion 220*b* and the conveyer C does not exist. That is, the tank coupling portion 210*b* and a non-bent portion of the header coupling portion 220*b* form a flat surface.

Meanwhile, the end cap 230 is formed not to protrude from an outer surface of the header 210 and the tank 220, so that when the aluminum radiator 100 is laid on the conveyer C, the tank coupling portion 210*b*, the header coupling portion 220*b* and the end cap 230 all contact the conveyer C, thereby preventing the tank 220 from sagging.

Figure 24:
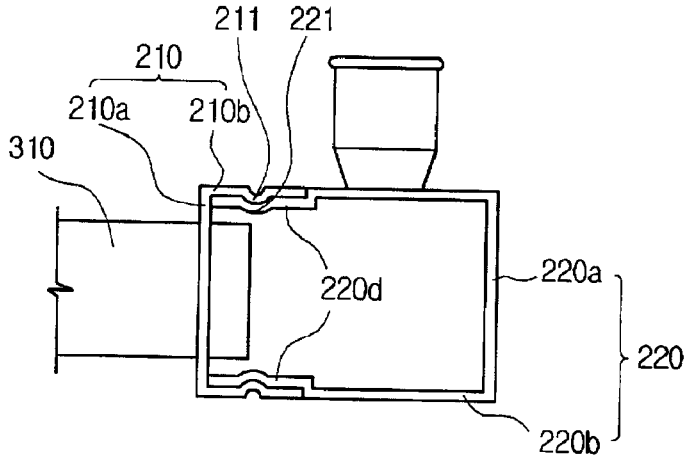
FIG. 24 is a cross-sectional view illustrating a first modification of a coupling portion between the header and the tank of the aluminum radiator of FIG. 23.

FIG. 24 is a cross-sectional view illustrating a first modification of a coupling portion between the header and the tank of the aluminum radiator of FIG. 23. Referring to FIG. 24, the bent portion 220*b* of the header coupling portion 220*b* includes a bead portion 211, and the tank coupling portion 210*b* includes a bead reception groove 221 formed at a location corresponding to the bead portion 211.

Figure 25:
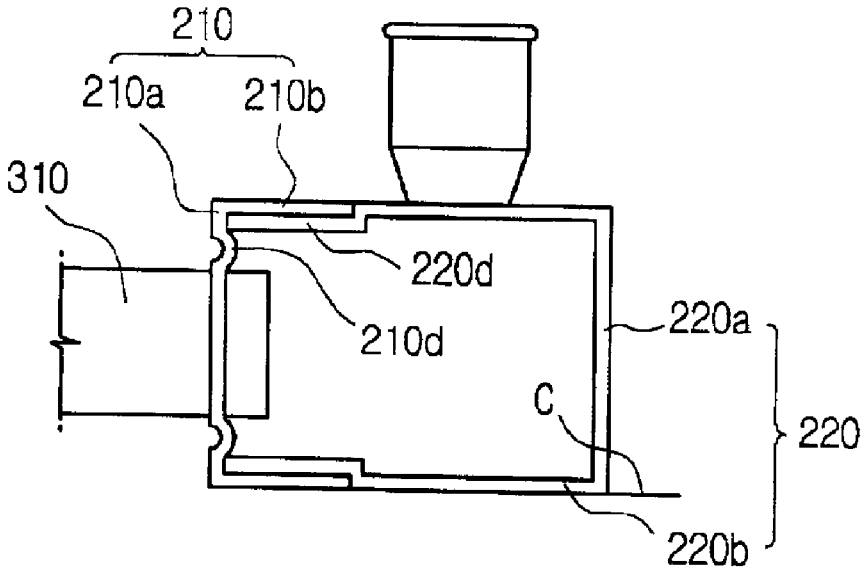
FIG. 25 is a cross-sectional view illustrating a second modification of a coupling portion between the header and the tank of the aluminum radiator of FIG. 23.

FIG. 25 is a cross-sectional view illustrating a second modification of a coupling portion between the header and the tank of the aluminum radiator of FIG. 23. Referring to FIG. 25, the flat portion 210*a* of the header 210 includes a bead portion 210*d*. The bead portion 210*d* is concavely formed at a location corresponding to an end portion of the bent portion 220*d* of the header coupling portion 220*b*. The bead portion 210*d* serves to prevent the bent portion 220*d* from coming off the tank coupling portion 210*b*.

Figure 26:
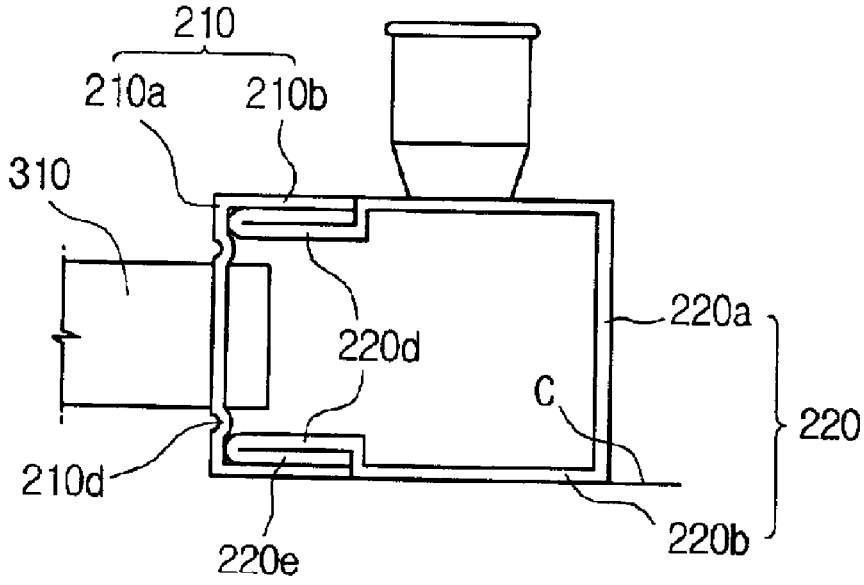
FIG. 26 is a cross-sectional view illustrating a third modification of a coupling portion between the header and the tank of the aluminum radiator of FIG. 23.

FIG. 26 is a cross-sectional view illustrating a third modification of a coupling portion between the header and the tank of the aluminum radiator of FIG. 23. Referring to FIG. 26, the bent portion 220*d* includes a curling portion 220*e* folded outwardly, and the flat portion 210*a* includes a bead portion 210*d*. The bead portion 210*d* is concavely formed at a location corresponding to an end portion of the bent portion 220*d*. The bead portion 210*d* serves to prevent the bent portion 220*d* from coming off the tank coupling portion 210*b*.

A step difference of the bent portion 220*d* is identical to a sum of a thickness of the tank coupling portion 210*b* and a thickness of the curling portion 220*e*. Therefore, when the bent portion 220*d* of the header coupling portion 220*b* is coupled to the tank coupling portion 210*b* of the header 210, a step difference between the header coupling portion 220*b* and the conveyer C does not exist. That is, the tank coupling portion 210*b* and a non-bent portion of the header coupling portion 220*b* form a flat surface.

Figure 27:
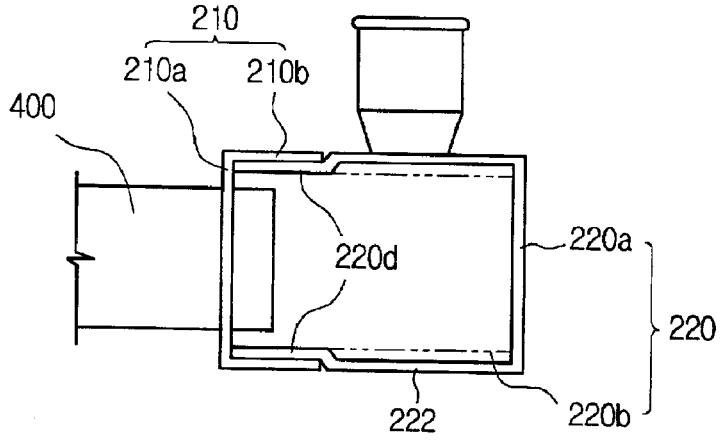
FIG. 27 is a cross-sectional view illustrating a fourth modification of a coupling portion between the header and the tank of the aluminum radiator of FIG. 23.
Figure 28:
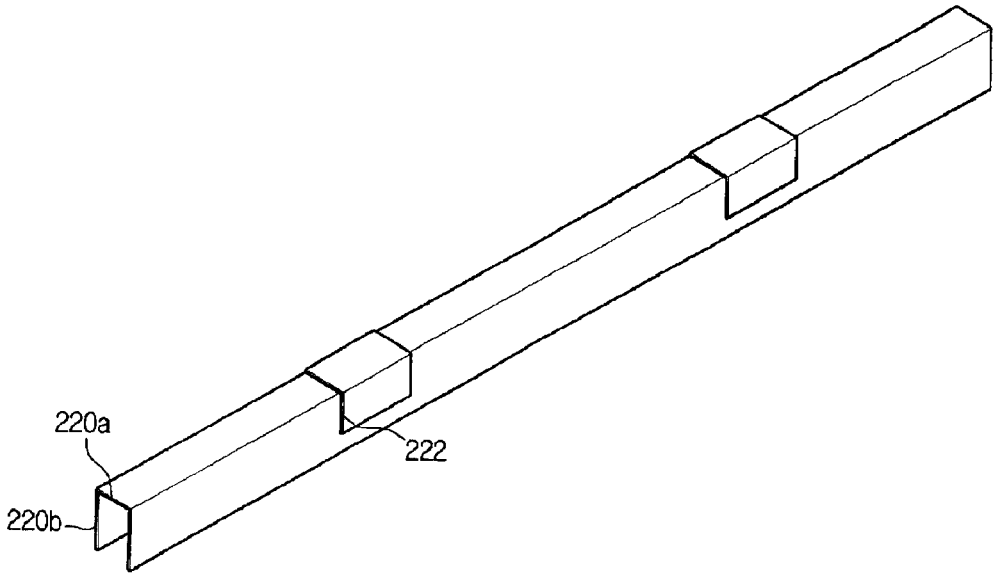
FIG. 28 is a perspective view illustrating a tank 220 of FIG. 27.

FIG. 27 is a cross-sectional view illustrating a fourth modification of a coupling portion between the header and the tank of the aluminum radiator of FIG. 23. FIG. 28 is a perspective view illustrating a tank 220 of FIG. 27.

The tank 220 includes a ceiling portion 220*a*, a header coupling portion 220*b* having a bent portion 220*d*, and a plurality of protruding portion 222 spaced apart from each other at a regular interval. A height of the protruding portion 222 is identical to a thickness of the tank coupling portion 210*b*. Therefore, when the tank coupling portion 210*b* is coupled to the bent portion 220*d*, the protruding portion 222 and a corresponding portion of the tank coupling portion 210*b* form a flat surface. As a result, the protruding portion 222 contacts a surface of the conveyer C when the aluminum radiator 100 is laid on the conveyer C, thereby preventing the tank 220 from sagging.

Meanwhile, the aluminum radiator according to the second embodiment of the present invention is designed such that the header coupling portion 220*b* includes the bent portion. But the aluminum radiator can be designed such that the tank coupling portion 210*b* includes the bent portion.

Figure 29:
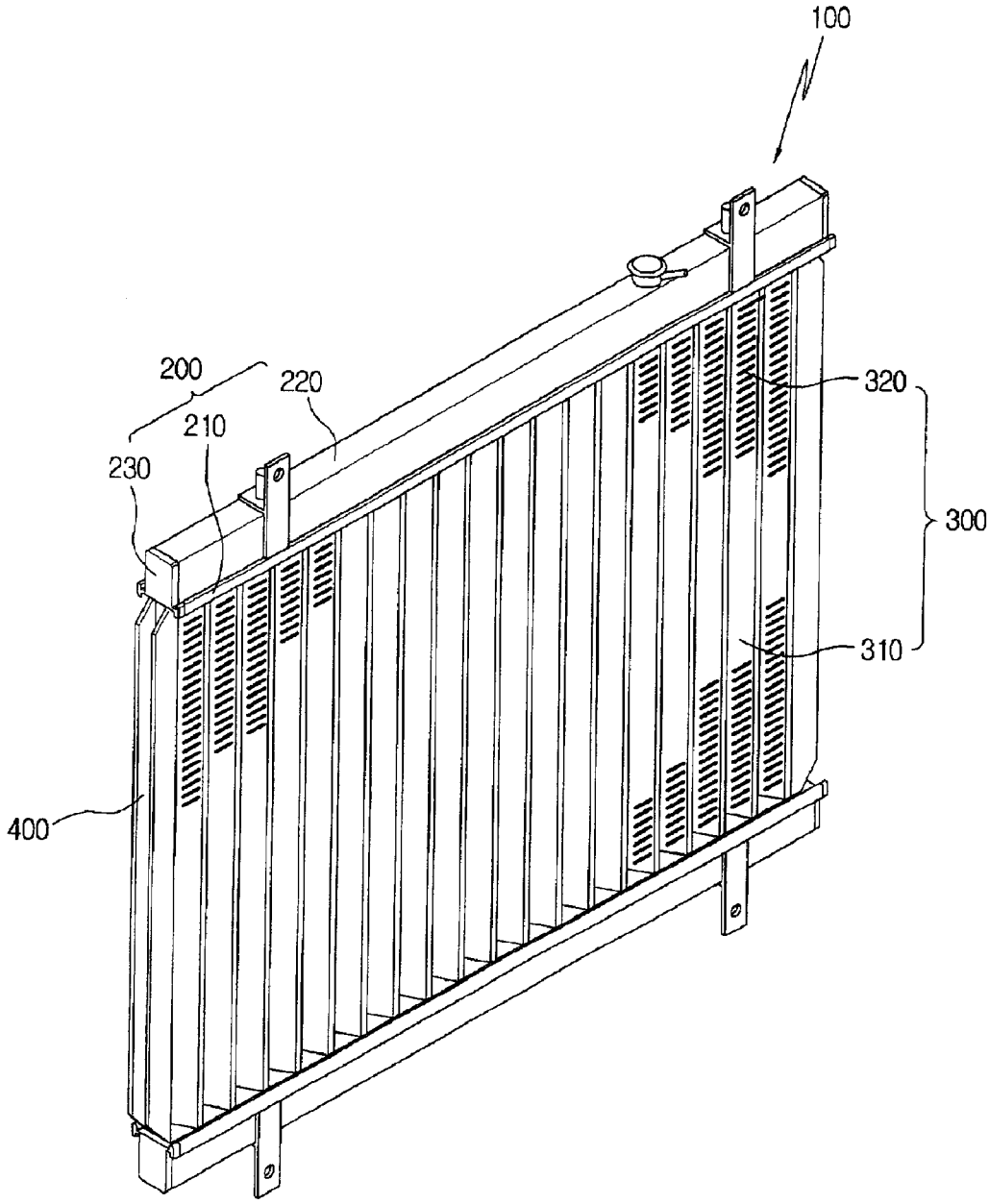
FIG. 29 is a perspective view of an aluminum radiator according to a third embodiment of the present invention.
Figure 30:
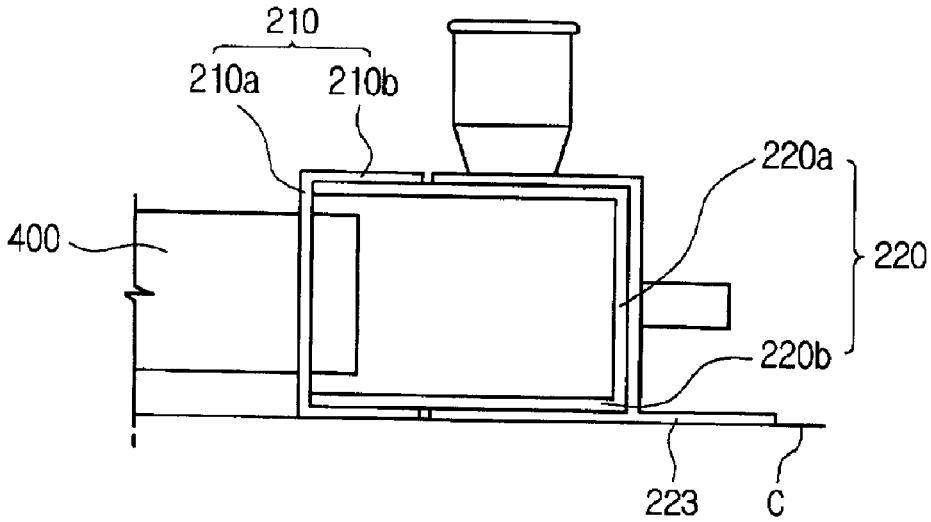
FIG. 30 is a cross-sectional view of the aluminum radiator FIG. 29.

FIG. 29 is a perspective view of an aluminum radiator according to a third embodiment of the present invention. FIG. 30 is a cross-sectional view of the aluminum radiator FIG. 29.

Referring to FIGS. 29 and 30, a plurality of mounting brackets 223 are arranged on an outer surface of the tank 220. The mounting bracket 223 has a thickness identical to a thickness of the tank coupling portion 210*b*. Since a step difference between the header coupling portion 220*b* and the conveyer C does not occur, a sagging of the tank 220 is prevented.

Figure 31:
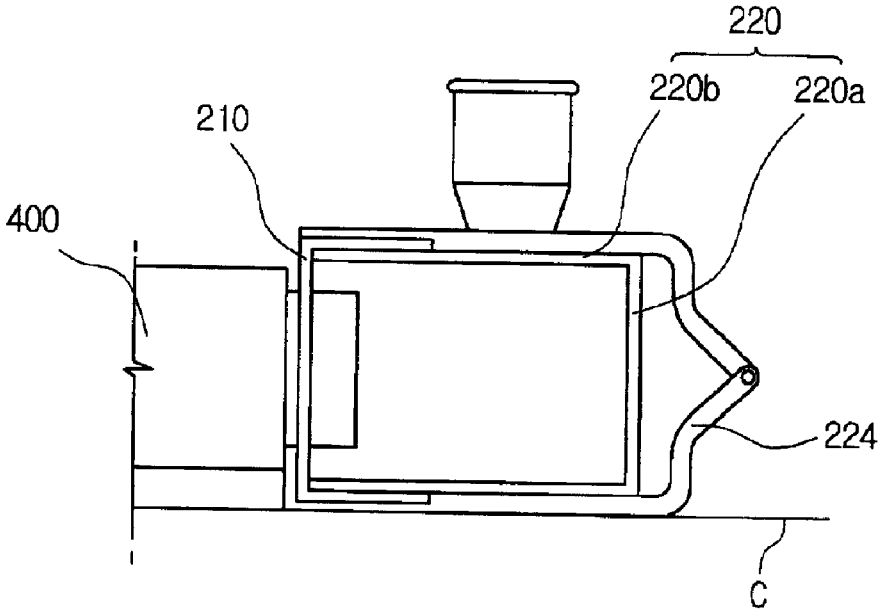
FIG. 31 is a cross-sectional view illustrating an aluminum radiator having a holder as a sag-preventing means.

Instead of the mounting bracket 223 of FIG. 29, as shown in FIG. 31, a holder 224 can be arranged on an outer surface of the tank, so that a step difference between the header coupling portion 220*b* and the conveyer C does not occur.

Figure 32:
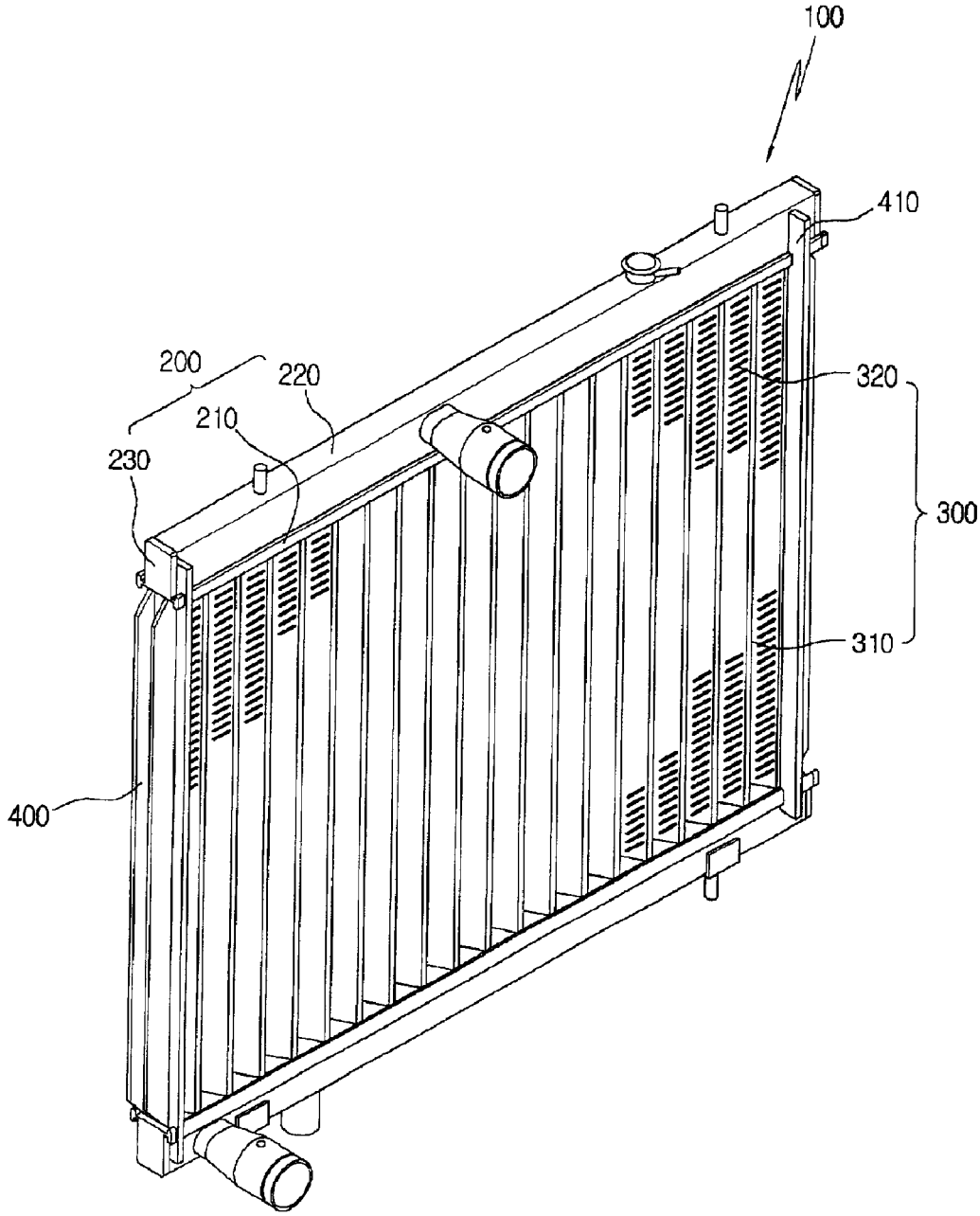
FIG. 32 is a perspective view of an aluminum radiator according to a fourth embodiment of the present invention.
Figure 33:
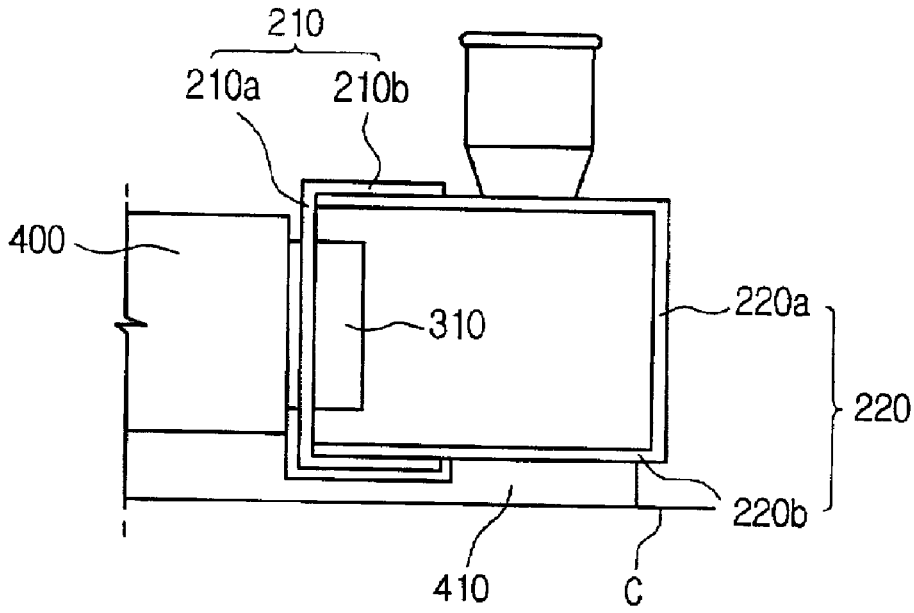
FIG. 33 is a cross-sectional view illustrating the aluminum radiator of FIG. 32.

FIG. 32 is a perspective view of an aluminum radiator according to a fourth embodiment of the present invention. FIG. 33 is a cross-sectional view illustrating the aluminum radiator of FIG. 32.

Referring to FIGS. 32 and 33, a sag-preventing means 410 is attached to the support 400, so that one side of the sag-preventing means 410 supports the header coupling portion 220*b* of the tank 220, and the other side of the sag-preventing means 410 contacts a surface of the conveyer C when the aluminum radiator is laid on the conveyer C. Therefore, a sagging of the tank 220 is prevented.

A process of manufacturing the tank 220 according to the embodiments of the present invention will be described below. The tank is manufactured using various methods such as a conventional progressive mold or a roll forming apparatus.

Figure 34:
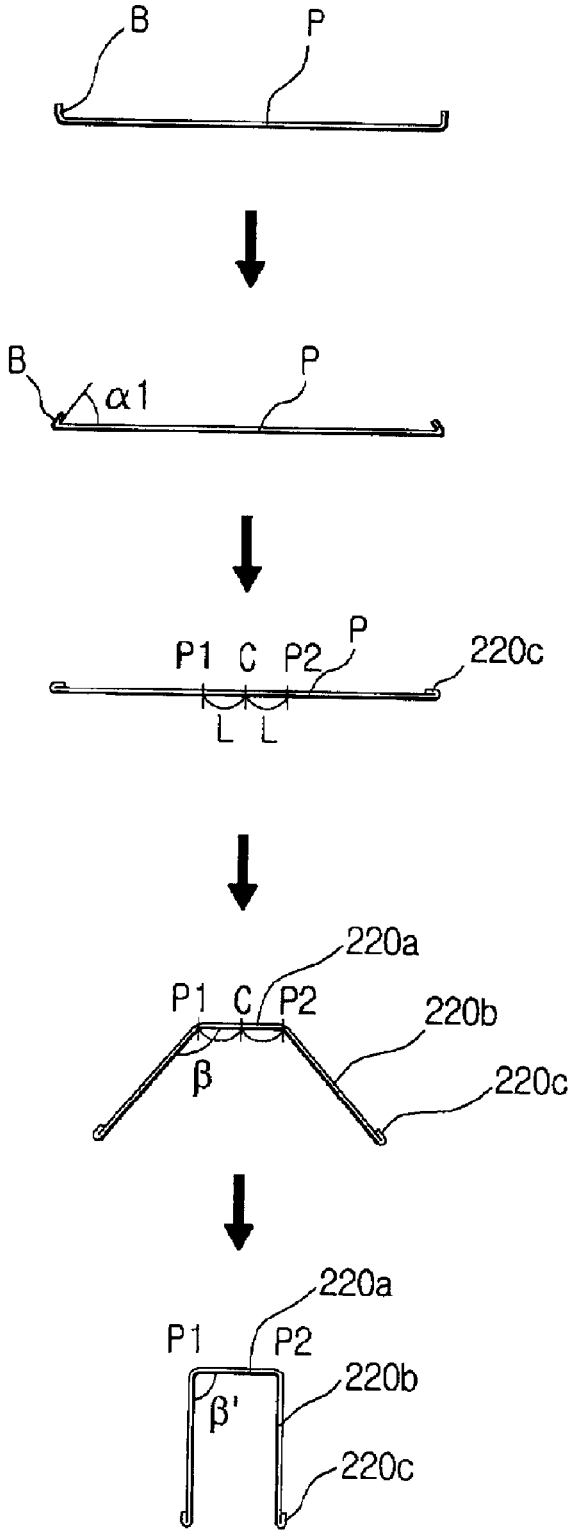
FIG. 34 is a processing view illustrating a process of manufacturing the tank of FIG. 19.

FIG. 34 is a processing view illustrating a process of manufacturing the tank of FIG. 19.

First, an aluminum plate P having a predetermined length and width is passed through a plurality of first forming rolls (not shown) engaged with one another, so that vertically bent portions B are formed on both end portions of the aluminum plate P.

The aluminum plate P having the vertically bent portions B is passed through a plurality of second forming rolls (not shown) having different shape from the first forming roll, so that curling portions 220*c* are formed on both end portions of the aluminum plate P. Here, angle $\alpha 1$ is an acute angle.

The aluminum plate P having the curling portions 220*c* is passed through a plurality of third forming rolls (not shown) having different shape from the first and second forming rolls, so that the aluminum plate P is bent at two points P1 and P2 of a L-distance from a central portion C thereof, thereby defining the ceiling portion 220*a* and the header coupling portion 220*b*. Here, an angle $\beta$ formed between the ceiling portion 220*a* and the header coupling portion 220*b* is an obtuse angle.

Finally, the aluminum plate P having the ceiling portion 220*a* and the header coupling portion 220*b* is passed through a plurality of fourth forming rolls (not shown) having different shape from the first to third forming rolls, so that the tank 220 is completed. Here, an angle $\beta'$ formed between the ceiling portion 220*a* and the header coupling portion 220*b* is a right angle.

Figure 35:
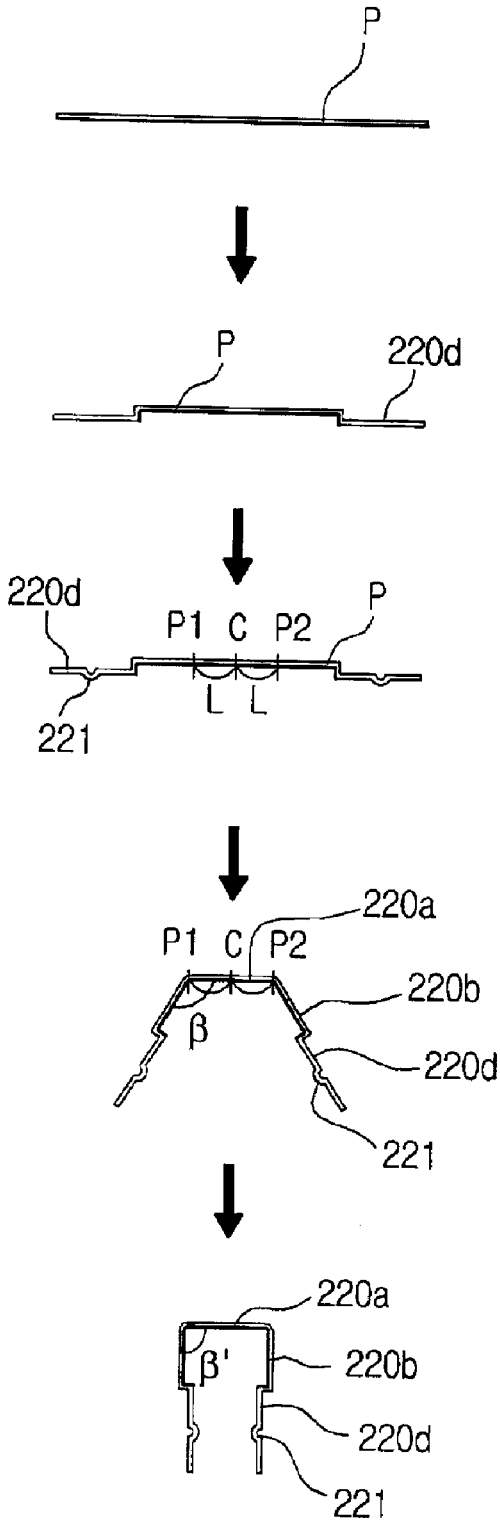
FIG. 35 is a processing view illustrating a process of manufacturing the tank of FIG. 24.

FIG. 35 is a processing view illustrating a process of manufacturing the tank of FIG. 24.

First, an aluminum plate P having a predetermined length and width is passed through a plurality of first forming rolls (not shown) engaged with one another, so that the bent portions 220*d* having a step difference identical to a thickness of the tank coupling portion 210*b* are formed on both end portions of the aluminum plate P.

The aluminum plate P having the bent portions 220*d* is passed through a plurality of second forming rolls (not shown) having different shape from the first forming roll, so that the bead portions 221 are formed in the bent portions 220*d* are formed on both end portions of the aluminum plate P.

The aluminum plate P having the bead portions 221 is passed through a plurality of third forming rolls (not shown) having different shape from the first and second forming rolls, so that the aluminum plate P is bent at two points P1 and P2 of a L-distance from a central portion C thereof, thereby defining the ceiling portion 220*a* and the header coupling portion 220*b*. Here, an angle $\beta$ formed between the ceiling portion 220*a* and the header coupling portion 220*b* is an obtuse angle.

Finally, the aluminum plate P having the ceiling portion 220*a* and the header coupling portion 220*b* is passed through a plurality of fourth forming rolls (not shown) having different shape from the first to third forming rolls, so that the tank 220 is completed. Here, an angle $\beta'$ formed between the ceiling portion 220*a* and the header coupling portion 220*b* is a right angle.

Figure 36:
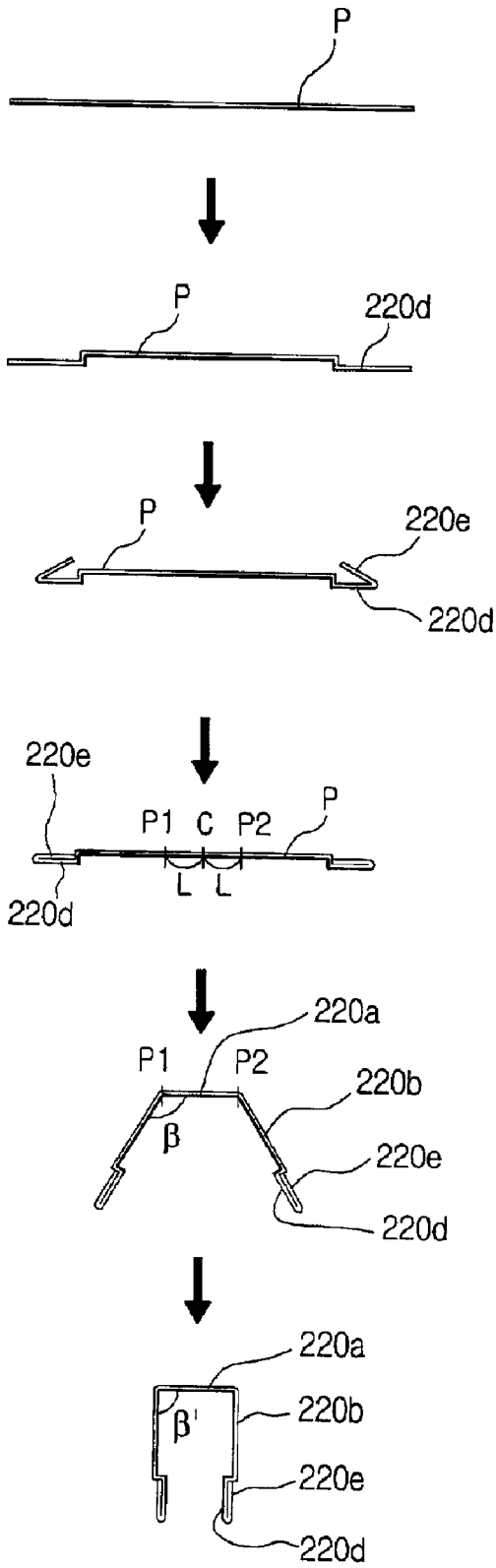
FIG. 36 is a processing view illustrating a process of manufacturing the tank of FIG. 26.

FIG. 36 is a processing view illustrating a process of manufacturing the tank of FIG. 26.

First, an aluminum plate P having a predetermined length and width is passed through a plurality of first forming rolls (not shown) engaged with one another, so that the bent portions 220*d* having a step difference identical to a thickness of the tank coupling portion 210*b* are formed on both end portions of the aluminum plate P.

The aluminum plate P having the bent portions 220*d* is passed through a plurality of second forming rolls (not shown) having different shape from the first forming roll, so that the curling portions 220*e* folded outwardly in an end portions of the bent portions 220*d* are formed.

The aluminum plate P having the curling portions 220*e* is passed through a plurality of third forming rolls (not shown) having different shape from the first and second forming rolls, so that the aluminum plate P is bent at two points P1 and P2 of a L-distance from a central portion C thereof, thereby defining the ceiling portion 220*a* and the header coupling portion 220*b*. Here, an angle $\beta$ formed between the ceiling portion 220*a* and the header coupling portion 220*b* is an obtuse angle.

Finally, the aluminum plate P having the ceiling portion 220*a* and the header coupling portion 220*b* is passed through a plurality of fourth forming rolls (not shown) having different shape from the first to third forming rolls, so that the tank 220 is completed. Here, an angle $\beta'$ formed between the ceiling portion 220*a* and the header coupling portion 220*b* is a right angle.

Only the process of manufacturing the tank is described above, but the header can also be manufactured in the same way.

The header and the tank according to the present invention can be manufactured using a single mold, regardless of a kind and a specification of vehicle. In addition, the header and the tank according to the present invention have an excellent quality regardless of a skill of a manufacturer.

As described herein before, the aluminum radiator according to the present invention has the following advantages.

Firstly, since the aluminum radiator is manufactured to a size which can minimize a pressure drop of a water and a transformation volume of the header tank, a flow rate of a cooling water is increased, thereby improving a cooling efficiency. Further, since an excessive pressure is not applied to an inside of the header tank and also a transformation does not occur when assembled, a reliability and a durability are improved. In addition, since the header tank is designed to an optimum size, an aluminum material is not wasted. Furthermore, a sagging of the tank is prevented without using a separate jig, a productivity is improved.

Besides, the header and the tank according to the present invention are manufactured using a single mold, regardless of a kind and a specification of vehicle, and have an excellent quality regardless of a skill of a manufacturer.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An aluminum radiator comprising:

a core including a plurality of tubes arranged side by side, and a plurality of fins positioned between the tubes, each said tube having a first end and a second end;

a pair of headers, one header attached to each end of said tubes, each header having first and second ends, and each header extending transversely with respect to said tubes;

a pair of tanks, one tank being coupled to a corresponding header by brazing to form a pair of sealed enclosures;

a cap connected to each end of each of said pair of headers; and wherein said tubes have an outside width T greater than or equal to 10 mm and less than or equal to 20 mm, and said tanks each have an inside height H greater than or equal to 15 mm, and less than or equal to 41 mm, and H divided by T is greater than or equal to 1.5 and less than or equal to 2.5.

2. An aluminum radiator, as claimed in claim 1 wherein:

each header includes a flat portion connected to said tubes, and each header further includes tank coupling portions formed at opposite ends of said flat portion thereby providing each header in a u-shape, and each tank includes a ceiling portion and a pair of header coupling portions formed at opposite ends of said ceiling portion thereby providing each tank in a complementary u-shape, wherein said tank coupling portions attach to said header coupling portions thereby creating said sealed enclosure for carrying a heat exchange medium therethrough, and a sag-preventing means is provided for preventing sagging between said headers and said tanks during assembly.

3. An aluminum radiator, as claimed in claim 2, wherein as the sag-preventing means, each said header coupling portion includes a bent portion having a thickness that is substantially the same as a thickness of said tank coupling portions, and said caps being sized so that said caps do not extend beyond an outside height or width of said headers and said tanks, wherein attachment of said tank coupling portions, said header coupling portions and said caps results in a continuous connection along a single plane.

4. An aluminum radiator, as claimed in claim 2, wherein:

each said tank coupling portion has a bead formed thereon and extending toward an interior of said corresponding enclosure, and each said header coupling portion includes a bead reception groove for receiving a corresponding bead from said tank coupling portion, said bead reception groove also extending toward said interior.

* * * * *